US010723580B2

(12) United States Patent
Nobe et al.

(10) Patent No.: US 10,723,580 B2
(45) Date of Patent: Jul. 28, 2020

(54) BINDING APPARATUS AND IMAGE PROCESSING APPARATUS

(71) Applicant: FUJI XEROX CO., LTD., Tokyo (JP)

(72) Inventors: Yutaka Nobe, Kanagawa (JP); Hiroaki Awano, Kanagawa (JP); Masashi Matsumoto, Kanagawa (JP); Takuya Makita, Kanagawa (JP); Naoto Terao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 100 days.

(21) Appl. No.: 16/044,008

(22) Filed: Jul. 24, 2018

(65) Prior Publication Data

US 2019/0292001 A1 Sep. 26, 2019

(30) Foreign Application Priority Data

Mar. 22, 2018 (JP) ..... 2018-053887
Mar. 22, 2018 (JP) ..... 2018-053888

(51) Int. Cl.
*B65H 37/04* (2006.01)
*B31F 5/02* (2006.01)

(52) U.S. Cl.
CPC ..... *B65H 37/04* (2013.01); *B31F 5/02* (2013.01); *B65H 2301/43828* (2013.01); *B65H 2301/51616* (2013.01); *B65H 2801/27* (2013.01)

(58) Field of Classification Search
CPC . B31F 5/02; B65H 37/04; B65H 2301/43828; B65H 2301/51616; B65H 2801/27
USPC ..... 270/58.08
See application file for complete search history.

(56) References Cited

U.S. PATENT DOCUMENTS 9,415,560 B2 * 8/2016 Morinaga ..... B42C 13/00
9,440,478 B2 * 9/2016 Takahashi ..... B42B 5/00
9,744,740 B2 * 8/2017 Abe ..... G03G 15/6544
2014/0353900 A1 * 12/2014 Abe ..... B42B 5/00 270/58.08
2015/0239587 A1 8/2015 Abe
2019/0291497 A1 * 9/2019 Matsumoto ..... B65H 37/04

FOREIGN PATENT DOCUMENTS

JP 2010-189101 A 9/2010
JP 2012-041163 A 3/2012
JP 2014-091249 A 5/2014

* cited by examiner

*Primary Examiner* — Leslie A Nicholson, III
(74) *Attorney, Agent, or Firm* — Oliff PLC

(57) ABSTRACT

A binding apparatus includes: a set of binding parts configured to press and bind a bundle of recording materials from one side and a remaining side in a thickness direction; a first support part configured to support the bundle of recording materials from the one side by performing rotation toward the bundle of recording materials around a predetermined fulcrum; and a second support part configured to support the bundle of recording materials from the remaining side so as to face the first support part when binding is performed by the set of binding parts.

10 Claims, 15 Drawing Sheets

BINDING APPARATUS AND IMAGE PROCESSING APPARATUS

CROSS-REFERENCE TO RELATED APPLICATIONS

This application is based on and claims priority under 35 USC 119 from Japanese Patent Application No. 2018-053888 filed Mar. 22, 2018 and Japanese Patent Application No. 2018-053887 filed Mar. 22, 2018.

BACKGROUND

(i) Technical Field

The present disclosure relates to a binding apparatus and an image processing apparatus.

(ii) Related Art

JP-A-2012-041163 discloses a recording material post-processing apparatus, which includes a binding unit that moves into the accumulation region of an accumulated bundle of sheets and forms deformation in the thickness direction on the bundle of sheets to bind the bundle of sheets and after binding the bundle of sheets, retreats out of the accumulation region of the bundle of sheets, a lower frame that supports the bundle of sheets when the binding unit binds the bundle of sheets, a protruding member that separates the bundle of sheets from the lower frame when the binding unit moves into the accumulation region of the bundle of sheets, and a moving frame that pushes the bundle of sheets between the lower frame 512 and therewith before the binding unit binds the bundle of sheets and also retreats the protruding member toward the lower frame side by a moving mechanism.

JP-A-2014-091249 discloses a sheet processing apparatus, which includes a sheet loading unit on which multiple sheets are loaded, a binding unit that includes a first toothed part having multiple teeth arranged thereon and a second toothed part provided so as to face the first toothed part and having multiple teeth arranged thereon and that moves at least one of the first toothed part or the second toothed part in the thickness direction of the sheets to engage the multiple sheets, loaded on the sheet loading unit, between the first toothed part and the second toothed part and perform a binding processing thereon, and a controller that controls a binding operation of the binding unit. The controller controls the binding unit so as to perform, at a predetermined timing, an idling operation of moving at least one of the first toothed part or the second toothed part in a state where there is no sheet between the first toothed part and the second toothed part so that the second toothed part and the second toothed part are engaged with each other.

In order to enhance the stability of a binding processing, for example, there is a technique that pushes a bundle of recording materials from the thickness direction by a sheet pushing part before performing the binding processing. In such a case, the sheet pushing part needs to move in the thickness direction of the bundle of recording materials. However, in order to achieve the movement in the thickness direction, the sheet pushing part needs to adopt a complicated configuration.

In order to prevent paper dust from adhering to a pressing part, there is a technique that removes the paper dust adhering to the pressing part having a toothed form by engaging teeth of the pressing part via, for example, an idling operation, but the paper dust may remain on the pressing part when the teeth are engaged. When the paper dust remains on the pressing part, the paper dust may harden, which may deteriorate a binding function by the pressing part.

SUMMARY

Aspects of non-limiting embodiments of the present disclosure relate to achieving the pushing of a bundle of recording materials using a mechanism having a simpler configuration than a sheet pushing part that linearly moves with respect to the thickness direction of the bundle of recording materials.

Aspects of non-limiting embodiments of the present disclosure also relate to enhancing the effect of removing paper dust, in comparison with a case where paper dust adhering to a pressing part is removed by idling the pressing part.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to an aspect of the present disclosure, there is provided a binding apparatus including: a set of binding parts configured to press and bind a bundle of recording materials from one side and a remaining side in a thickness direction; a first support part configured to support the bundle of recording materials from the one side by performing rotation toward the bundle of recording materials around a predetermined fulcrum; and a second support part configured to support the bundle of recording materials from the remaining side so as to face the first support part when binding is performed by the set of binding parts.

BRIEF DESCRIPTION OF THE DRAWINGS

Exemplary embodiments of the present disclosure will be described in detail based on the following figures, wherein.

DETAILED DESCRIPTION

Hereinafter, an exemplary embodiment of the present disclosure will be described in detail with reference to the accompanying drawings.

<Recording Material Processing System 200>

Figure 1:
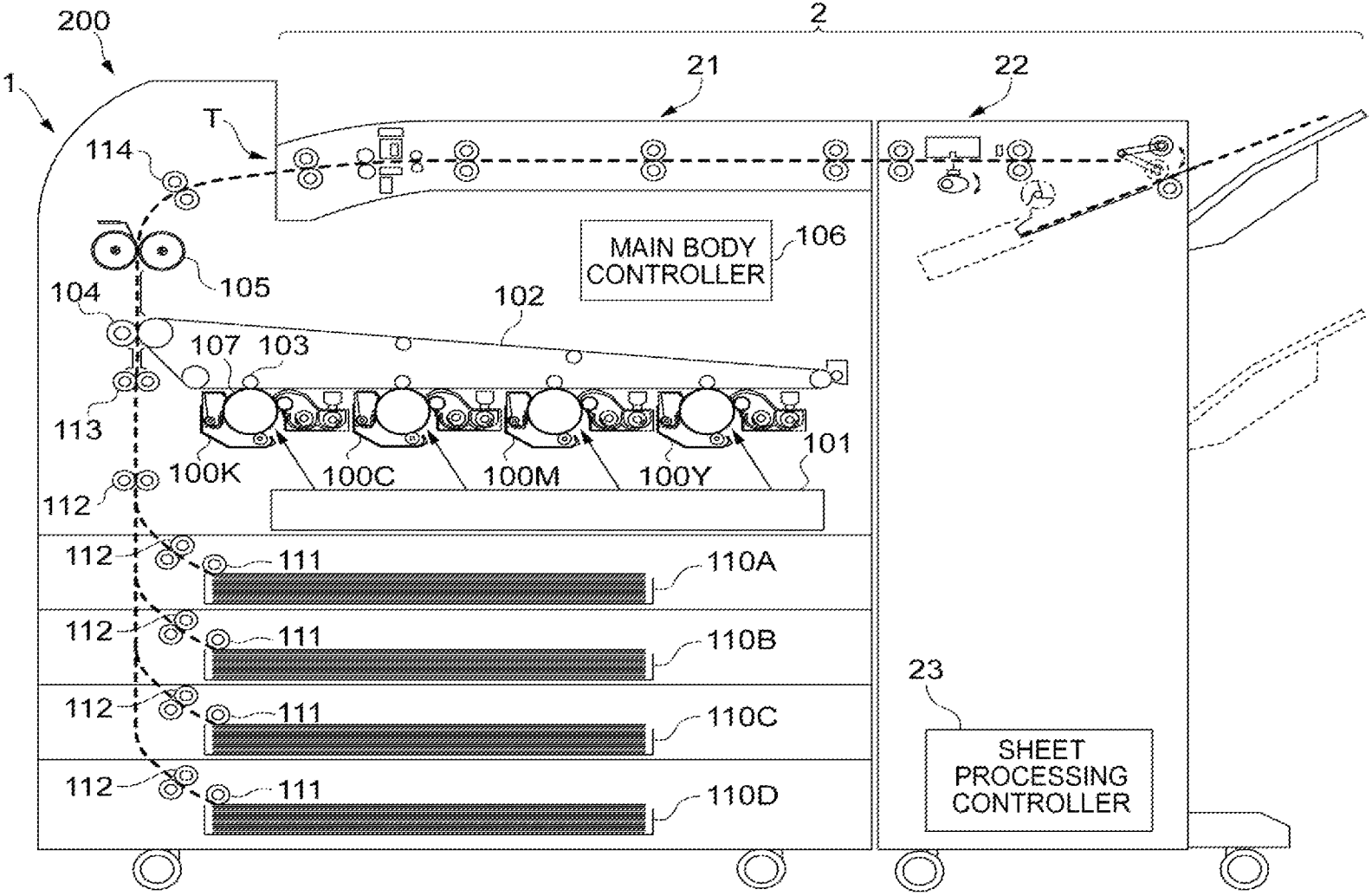
FIG. 1 is a view illustrating a configuration of a recording material processing system according to an exemplary embodiment.

FIG. 1 is a view illustrating a configuration of a recording material processing system 200 according to the present exemplary embodiment.

The recording material processing system 200, which functions as an image processing apparatus, is provided with an image forming apparatus 1 that forms an image on a recording material (sheet) such as, for example, paper in an image forming unit using, for example, an electrophotographic process, and with a post-processing apparatus 2 serving as a binding apparatus that performs a binding processing on multiple sheets, on which the image is formed by the image forming apparatus 1. In addition, the image processing apparatus may be grasped as including the image forming apparatus 1 or the post-processing apparatus 2 alone, or the image processing apparatus may be grasped as including both the image forming apparatus 1 and the post-processing apparatus 2. In addition, the binding apparatus may be grasped as including the post-processing apparatus 2 described above alone, or the binding apparatus may be grasped as including both the image forming apparatus 1 and the post-processing apparatus 2. In addition, only a functional part that performs binding may be extracted from the post-processing apparatus 2 and may be grasped as the binding apparatus.

<Image Forming Apparatus 1>

The image forming apparatus 1 includes four image forming units 100Y, 100M, 100C and 100K (hereinafter also collectively referred to as "image forming units 100") that perform image formation based on respective color image data. In addition, the image forming apparatus 1 is provided with a laser exposure device 101 that exposes a photoconductor drum 107 provided in each image forming unit 100 to form an electrostatic latent image on the surface of the photoconductor drum 107.

In addition, the image forming apparatus 1 is provided with an intermediate transfer belt 102, to which toner images of respective colors formed by the respective image forming units 100 are multi-transferred, and primary transfer rollers 103 that sequentially transfer (primarily transfer) the toner images of respective colors, formed in the respective image forming units 100, to the intermediate transfer belt 102. In addition, the image forming apparatus 1 is provided with a secondary transfer roller 104 that collectively transfers (secondarily transfers) the toner images of respective colors, transferred onto the intermediate transfer belt 102, onto a sheet, a fixing device 105 that fixes the secondarily transferred toner images of respective colors on the sheet, and a main body controller 106 that controls an operation of the image forming apparatus 1.

In each of the image forming units 100, charging of the photoconductor drum 107 and formation of the electrostatic latent image on the photoconductor drum 107 are performed. Then, the electrostatic latent image is developed, so that the toner image of each color is formed on the surface of the photoconductor drum 107.

The toner image of each color, formed on the surface of the photoconductor drum 107, is sequentially transferred onto the intermediate transfer belt 102 by the primary transfer roller 103. Then, the toner image of each color is transported to a position, at which the secondary transfer roller 104 is provided, as the intermediate transfer belt 102 moves.

Different sizes or different kinds of sheets are accommodated in sheet accommodating units 110A to 110D of the image forming apparatus 1. Then, for example, a sheet is taken out from the sheet accommodating unit 110A by a pickup roller 111, and is transported to a registration roller 113 by a transport roller 112.

Then, in accordance with a timing at which the toner images of respective colors on the intermediate transfer belt 102 are transported to the secondary transfer roller 104, the sheet is supplied from the registration roller 113 to a facing region (secondary transfer region) in which the secondary transfer roller 104 and the intermediate transfer belt 102 face each other.

Then, the toner images of respective colors on the intermediate transfer belt 102 are collectively electrostatically transferred (secondarily transferred) onto the sheet by the action of a transfer electric field formed by the secondary transfer roller 104.

Thereafter, the sheet, onto which the toner images of respective colors have been transferred, is separated from the intermediate transfer belt 102 and is transported to the fixing device 105. In the fixing device 105, the toner images of respective colors are fixed on the sheet by a fixing processing using heat and pressure, so that an image is formed on the sheet.

Then, the sheet, on which the image has been formed, is discharged from a sheet discharge unit T of the image forming apparatus 1 by the transport roller 114, and is supplied to the post-processing apparatus 2 connected to the image forming apparatus 1.

The post-processing apparatus 2 is disposed downstream of the sheet discharge unit T of the image forming apparatus 1, and performs a post-processing such as, for example, drilling or binding on the sheet on which the image has been formed.

<Post-Processing Apparatus 2>

Figure 2:
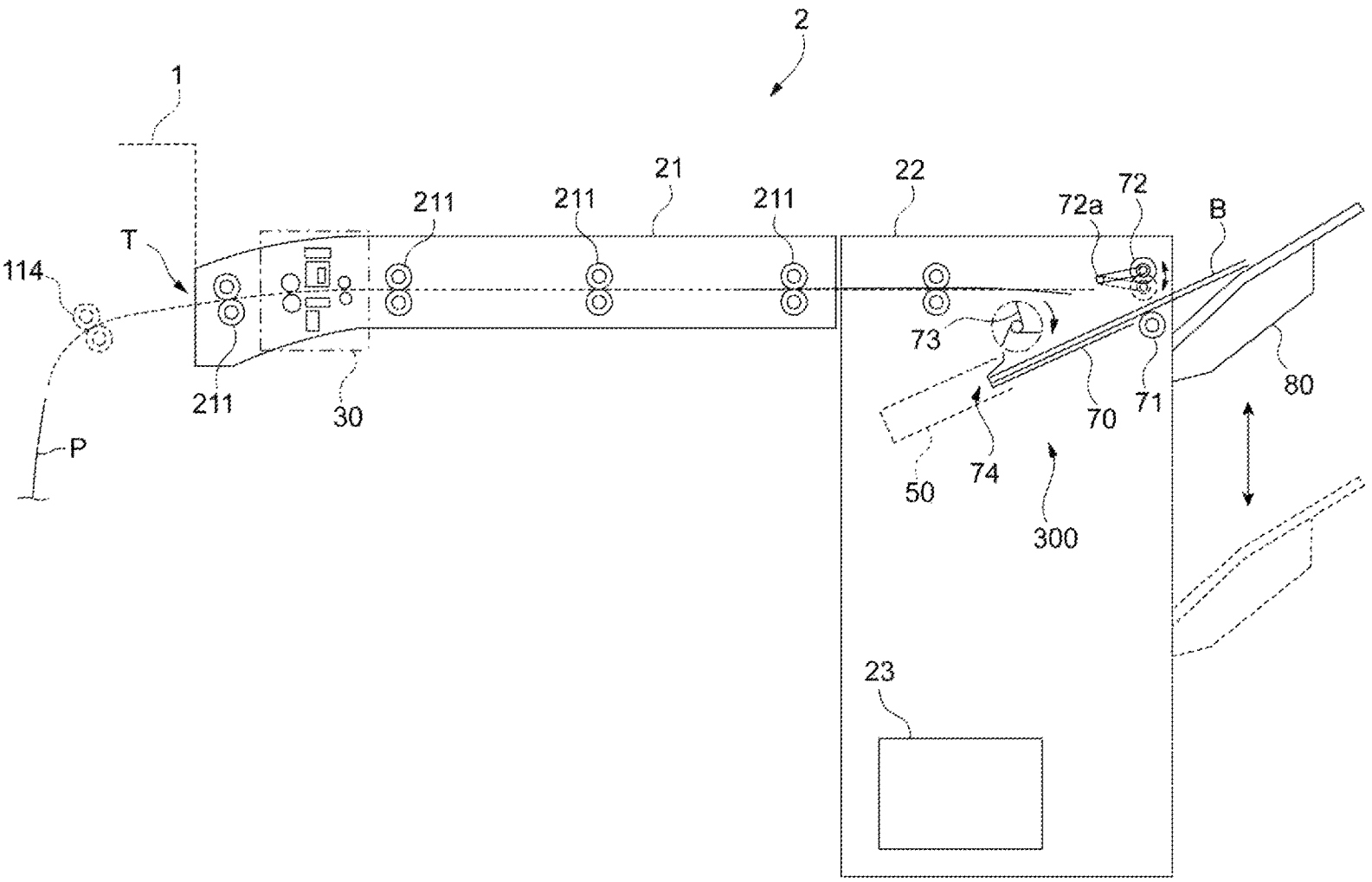
FIG. 2 is a view for explaining a configuration of a post-processing apparatus according to the present exemplary embodiment.

FIG. 2 is a view for explaining a configuration of the post-processing apparatus 2.

As illustrated in FIG. 2, the post-processing apparatus 2, which functions as an image processing apparatus, includes a transport unit 21 that is connected to the sheet discharge unit T of the image forming apparatus 1, and a finisher unit 22 that performs a predetermined processing on the sheet transported by the transport unit 21. Various transport paths of the transport unit 21 or the finisher unit 22 function as a transport unit that transports a recording material on which an image is formed. In addition, transport paths before and after the image formation of the image forming apparatus 1 also function as a transport unit.

In addition, the post-processing apparatus 2 includes a sheet processing controller 23 (see FIG. 1) that controls each mechanism of the post-processing apparatus 2. The sheet processing controller 23 is connected to the main body controller 106 (see FIG. 1) via a signal line (not illustrated) to perform mutual transmission and reception of control signals, for example. In addition, the post-processing apparatus 2 includes a stacker part 80 in which sheets (bundle of sheets) completely processed by the post-processing apparatus 2 are loaded.

As illustrated in FIG. 2, the transport unit 21 of the post-processing apparatus 2 is provided with a punching functional part 30 that performs drilling (punching) of two holes or four holes, for example. In addition, the transport unit 21 is provided with multiple transport rollers 211 that transport the sheet, on which the image has been formed by the image forming apparatus 1, toward the finisher unit 22.

The finisher unit 22 is provided with a binding processing device 300 that performs a binding processing on a bundle of sheets as an example of a bundle of recording materials. The binding processing device 300 of the present exemplary embodiment performs a binding processing on the bundle of sheets by entangling fibers, which constitute a sheet, with each other without using staples (needles). In addition, the binding processing device 300 may be grasped as a binding apparatus.

The binding processing device 300 is provided with a sheet accumulation unit 70 that supports sheets from below and accumulates a required number of sheets to generate a bundle of sheets. The sheet accumulation unit 70 functions as an accommodating unit that accommodates therein a bundle of recording materials in which a recording material transported by the transport unit is bundled. In addition, the binding processing device 300 is provided with a binding unit 500 that performs a binding processing on the bundle of sheets. In addition, the sheet accumulation unit 70 has a mode in which sheets are accommodated one by one so that a bundle of sheets is accommodated as well as a mode in which sheets are collectively accommodated as a bundle of sheets.

In addition, the binding processing device 300 is provided with a carry-out roll 71 and a moving roll 72. The carry-out roll 71 rotates in the clockwise direction in the drawing to send the bundle of sheets on the sheet accumulation unit 70 to the stacker part 80. The moving roll 72 is movably provided around a rotating shaft 72*a*, and is located at a position, at which it is retreat from the carry-out roll 71, when accumulating sheets on the sheet accumulation unit 70. In addition, when sending the generated bundle of sheets to the stacker part 80, the moving roll 72 is pressed against the bundle of sheets on the sheet accumulation unit 70.

The post-processing apparatus 2 executes a processing on the sheet after the sheet processing controller 23 receives an instruction signal to the effect of executing the processing on the sheet from the main body controller 106. Then, in the post-processing apparatus 2, first, the sheet on which image formation has been performed by the image forming apparatus 1 is supplied to the transport unit 21. In the transport unit 21, after drilling is performed by the punching functional part 30 in response to an instruction signal from the sheet processing controller 23, the sheet is transported toward the finisher unit 22 by the transport rollers 211. On the other hand, when there is no drilling instruction from the sheet processing controller 23, the sheet is sent to the finisher unit 22 without the implementation of a drilling processing by the punching functional part 30.

The sheet sent to the finisher unit 22 is transported to the sheet accumulation unit 70 provided in the binding processing device 300. Then, the sheet slides on the sheet accumulation unit 70 using the inclination angle given to the sheet accumulation unit 70, and stops when coming into contact with sheet regulators 74 provided on the end portions of the sheet accumulation unit 70. When the sheet comes into contact with the sheet regulators 74, a bundle of sheets is generated on the sheet accumulation unit 70 in a state where trailing end portions of sheets are aligned. In addition, in the present exemplary embodiment, a rotating paddle 73 is provided to move the sheet toward the sheet regulators 74.

Figure 3:
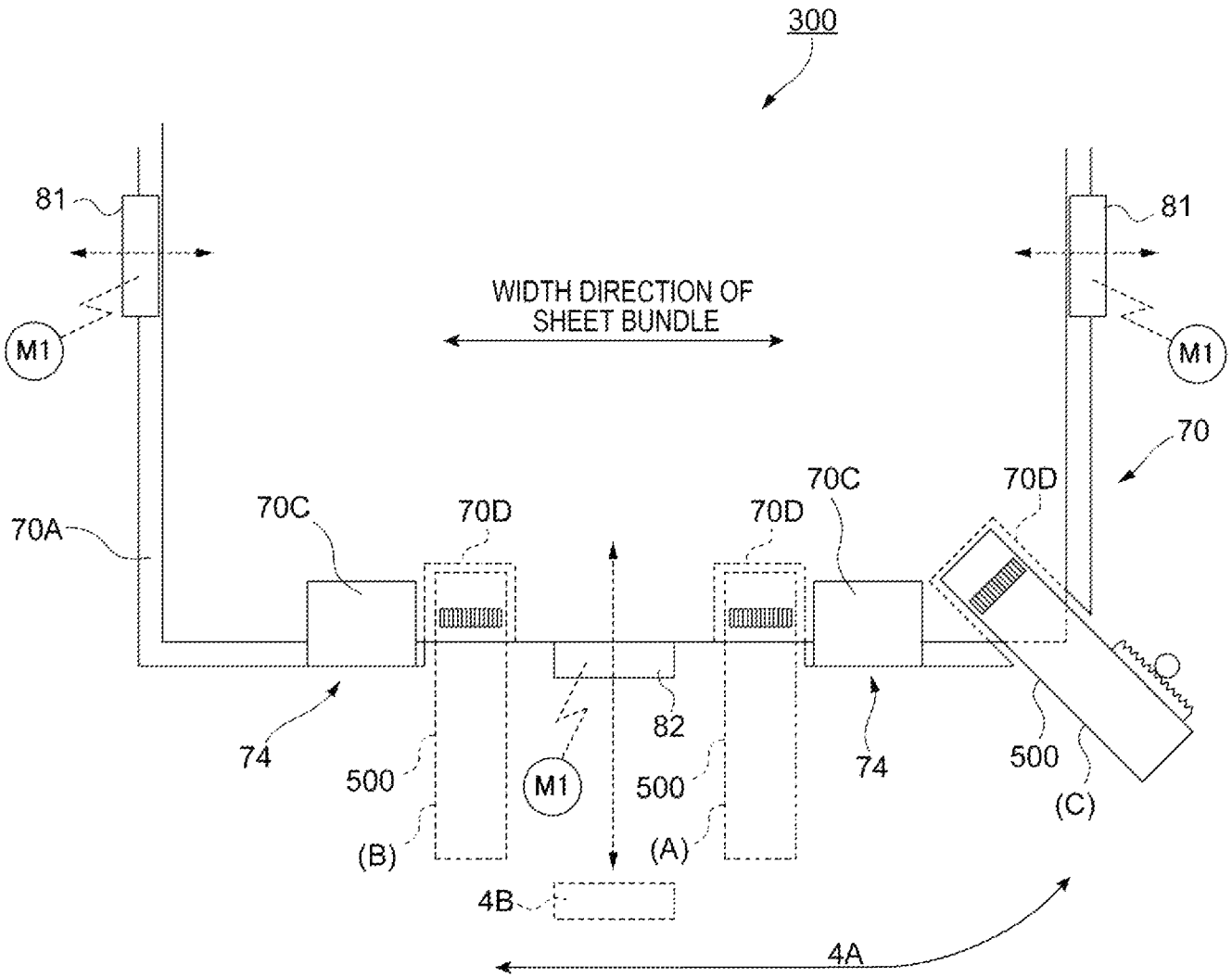
FIG. 3 is a view illustrating a binding processing apparatus according to the present exemplary embodiment in which the binding processing apparatus is viewed from above.

FIG. 3 is a view illustrating a case when viewing the binding processing device 300 from above.

First moving members 81 are provided on both end portions in the width direction of the sheet accumulation unit 70.

The first moving members 81 push the sides of the sheet constituting the bundle of sheets to align positions of end portions of the sheet constituting the bundle of sheets. In addition, the first moving members 81 move in the width direction of the bundle of sheets to move the bundle of sheets in the width direction of the bundle of sheets. When the sheet is accumulated on the sheet accumulation unit 70, the first moving members 81 are pushed to the sides of the sheet, so that positions of the sides of the sheet are aligned. In addition, when a binding position of the bundle of sheets is changed, the bundle of sheets is pressed by the first moving members 81 so as to move in the width direction of the bundle of sheets.

In addition, the binding processing device 300 is provided with a second moving member 82 that moves in the direction orthogonal to the drawing to move the bundle of sheets in a direction orthogonal to the width direction of the bundle of sheets and a moving motor M1 that moves the first moving members 81 and the second moving member 82.

As indicated by an arrow 4A in FIG. 3, the binding unit 500 is provided so as to be movable in the width direction of the sheet. Then, for example, the binding unit 500 performs a binding processing (two-point binding processing) at two points (position (A) and position (B)) located at different positions in the width direction of the bundle of sheets.

In addition, the binding unit 500 moves to the position (C) in FIG. 3, and performs a binding processing (one-point binding) at the corner portion of the bundle of sheets. Between the position (A) and the position (B), the binding unit 500 moves linearly. Between the position (A) and the position (C), the binding unit 500 moves while rotating by 45 degrees, for example.

Each sheet regulator 74 includes a facing portion 70C disposed to face a bottom plate 70A. The facing portion 70C comes into contact with the uppermost sheet of the bundle of sheets to regulate the movement of the sheet in the thickness direction of the bundle of sheets. In addition, in the exemplary embodiment, a binding processing by the binding unit 500 is performed at a position at which the sheet regulator 74 and the second moving member 82 are not provided. More specifically, as illustrated in FIG. 3, a binding processing by the binding unit 500 is performed between the sheet regulator 74 located on the left side of the drawing and the second moving member 82 and between the sheet regulator 74 located on the right side of the drawing and the second moving member 82. In addition, a binding processing is performed at a position (a corner portion of the bundle of sheets) adjacent to the sheet regulator 74 on the right side of the drawing.

In addition, as illustrated in FIG. 3, three notches 70D are provided in the bottom plate 70A. Thereby, interference between the sheet accumulation unit 70 and the binding unit 500 may be avoided. In addition, when the binding unit 500 moves, the second moving member 82 moves to a position indicated by reference numeral 4B in FIG. 3. Thereby, interference between the binding unit 500 and the second moving member 82 may be avoided.

<Structure of Binding Unit 500>

Next, the binding unit 500 according to the present exemplary embodiment will be described.

The binding unit 500 according to the present exemplary embodiment functions as a binding apparatus that binds a bundle of recording materials (bundle of sheets) without using needles. For example, the binding unit binds a bundle of sheets of two to ten sheets by pressing the bundle of sheets using upper teeth and lower teeth thereof.

At this time, in order to enhance the stability of a binding processing, before performing the binding processing, a sheet pushing part needs to move in the thickness direction of the bundle of sheets so as to push the bundle of sheets from the thickness direction thereof. However, in order to achieve the movement of the sheet pushing part in the thickness direction, the sheet pushing part needs to adopt a complicated configuration, for example, a moving mechanism that moves a dedicated sheet pushing part in the thickness direction thereof.

In addition, at this time, in particular, in order to bind a bundle of sheets of a large number of sheets satisfactorily, a very large pressing force is applied. By this pressing force, paper dust is adhering to a pressing part when binding the bundle of sheets. In addition, the attachment of paper dust affects engagement of the pressing part, which may make it impossible to obtain a predetermined pressing force. In addition, when paper dust remains on the pressing part, the paper dust may harden, which may deteriorate a binding function by the pressing part.

In the binding unit 500 according to the present exemplary embodiment, it is possible to press the bundle of recording materials from the thickness direction by a mechanism having a simple configuration to be described later.

In addition, the binding unit 500 according to the present exemplary embodiment effectively removes paper dust by a configuration to be described later.

Figure 4:
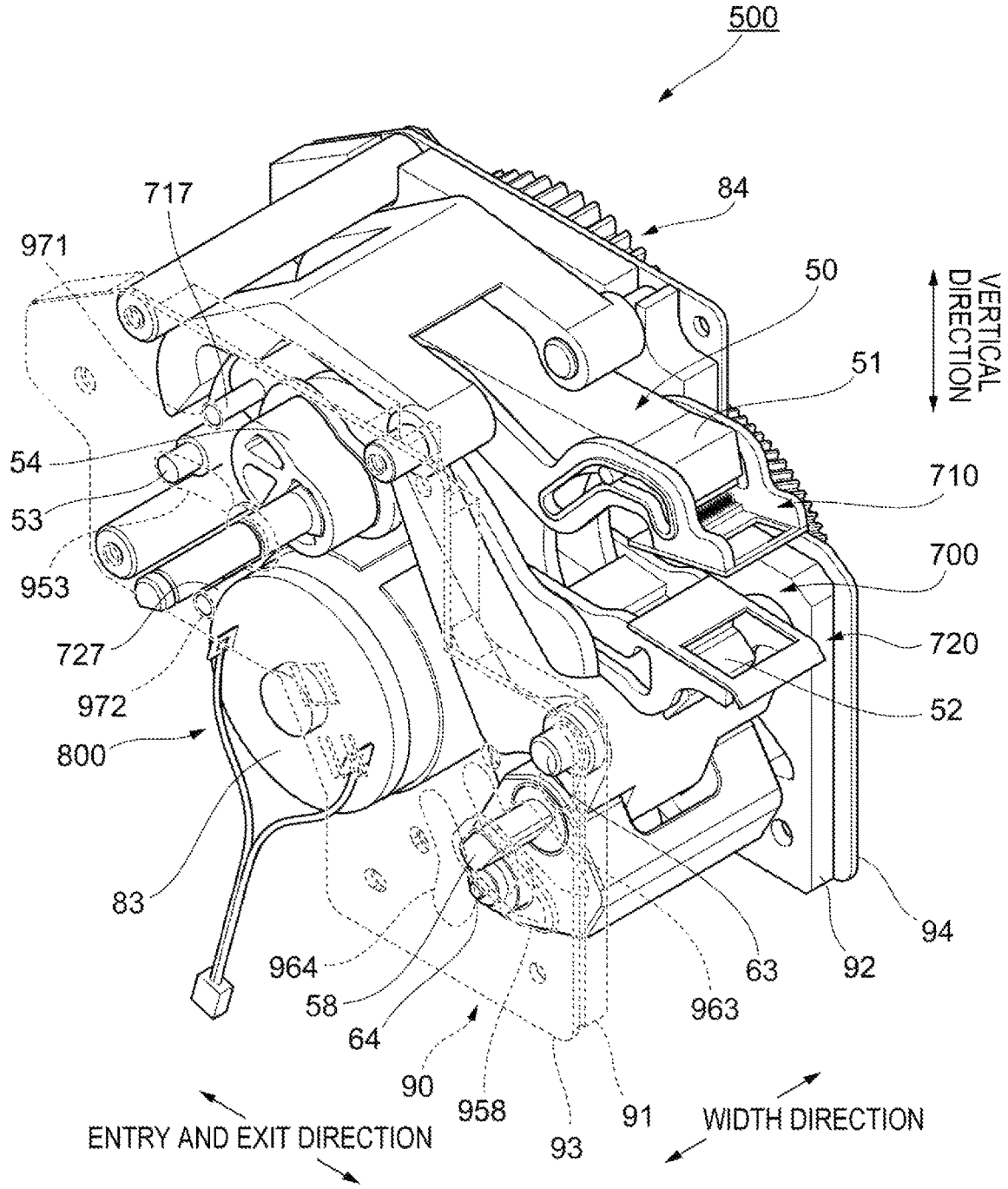
FIG. 4 is a perspective view of a binding unit according to the present exemplary embodiment.
Figure 5:
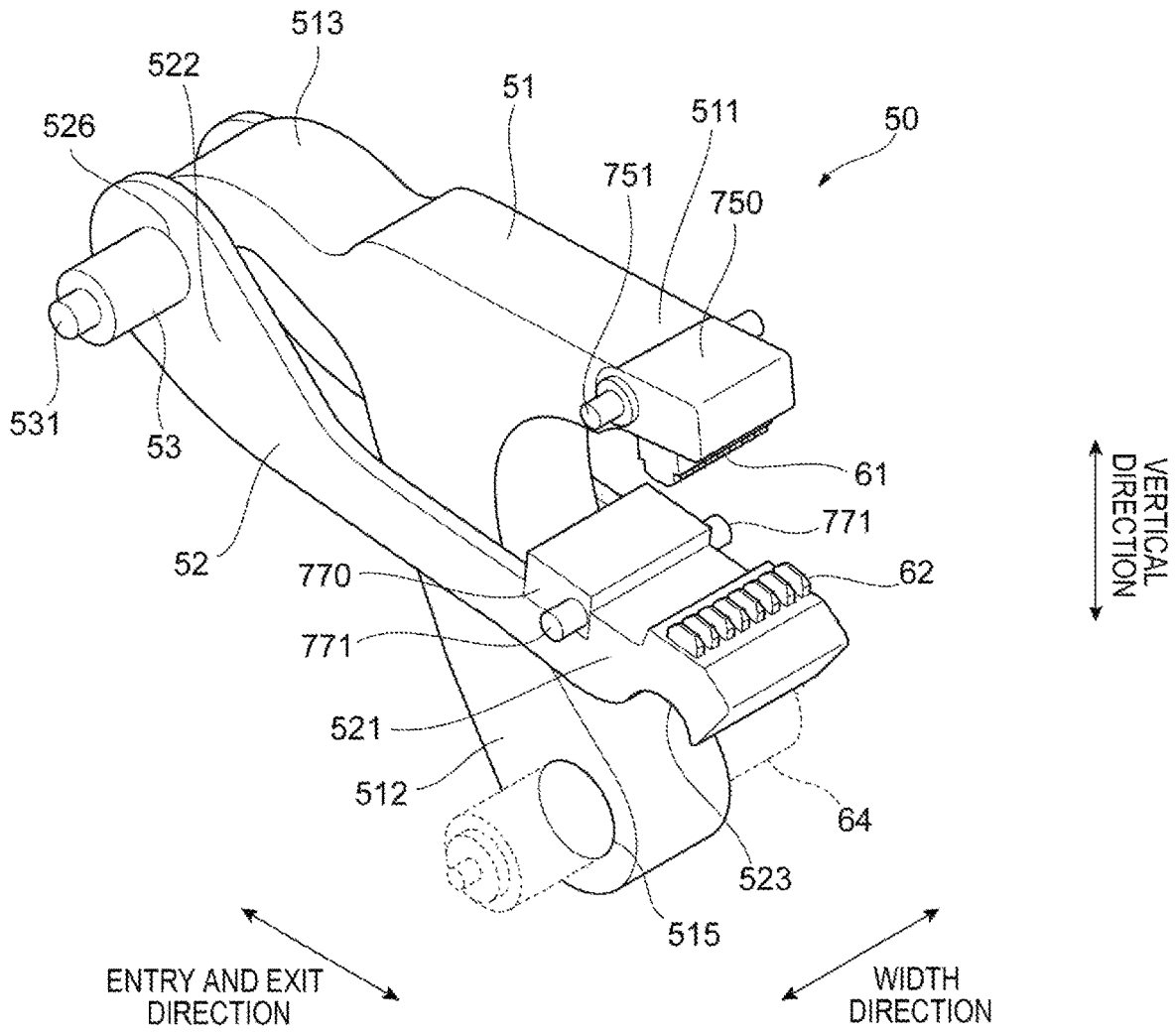
FIG. 5 is a view for explaining a configuration of a binding structure of the binding unit according to the present exemplary embodiment.
Figure 6:
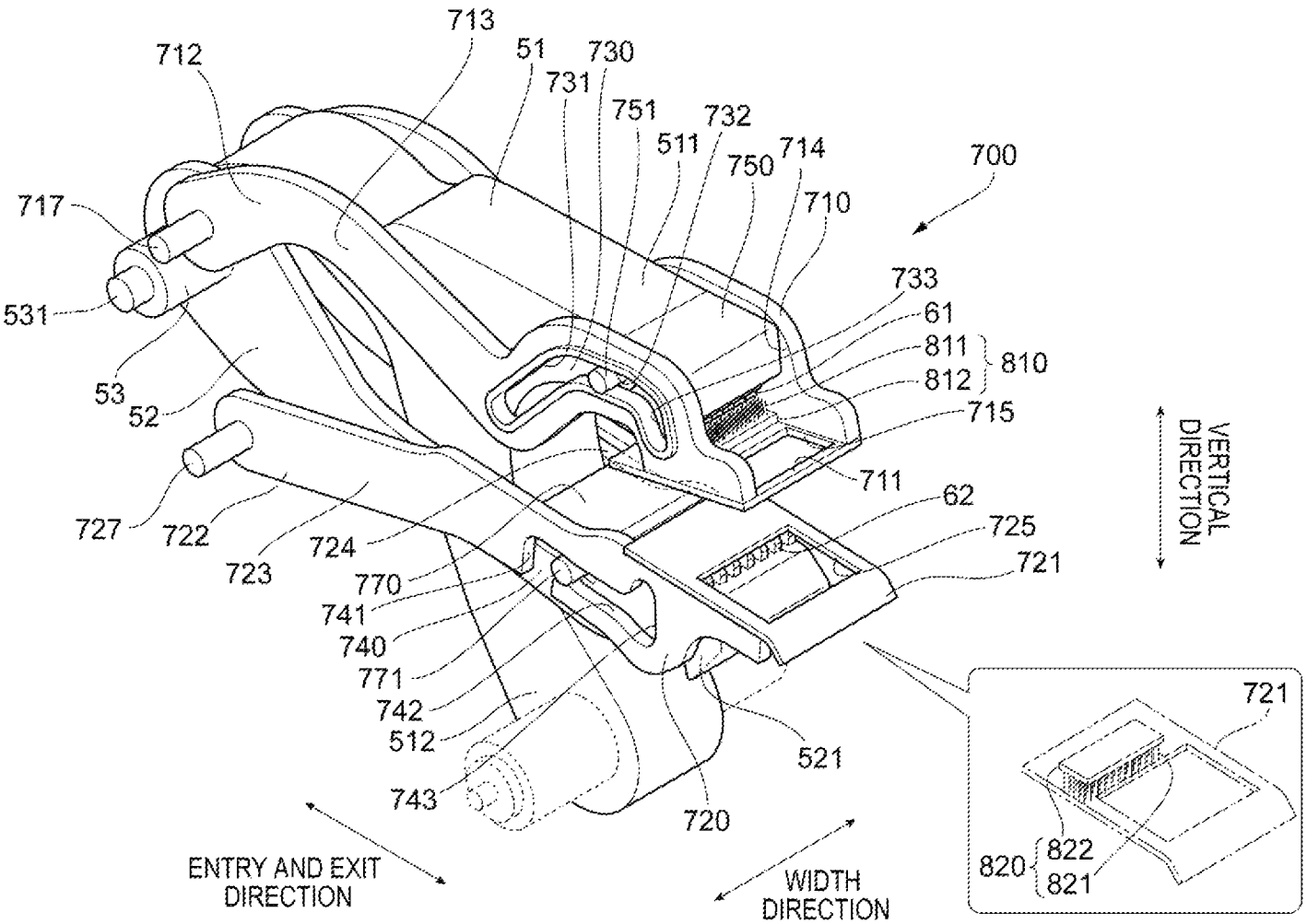
FIG. 6 is a view for explaining a position of the binding unit according to the present exemplary embodiment, which comes into contact with a bundle of recording materials.
Figure 7:
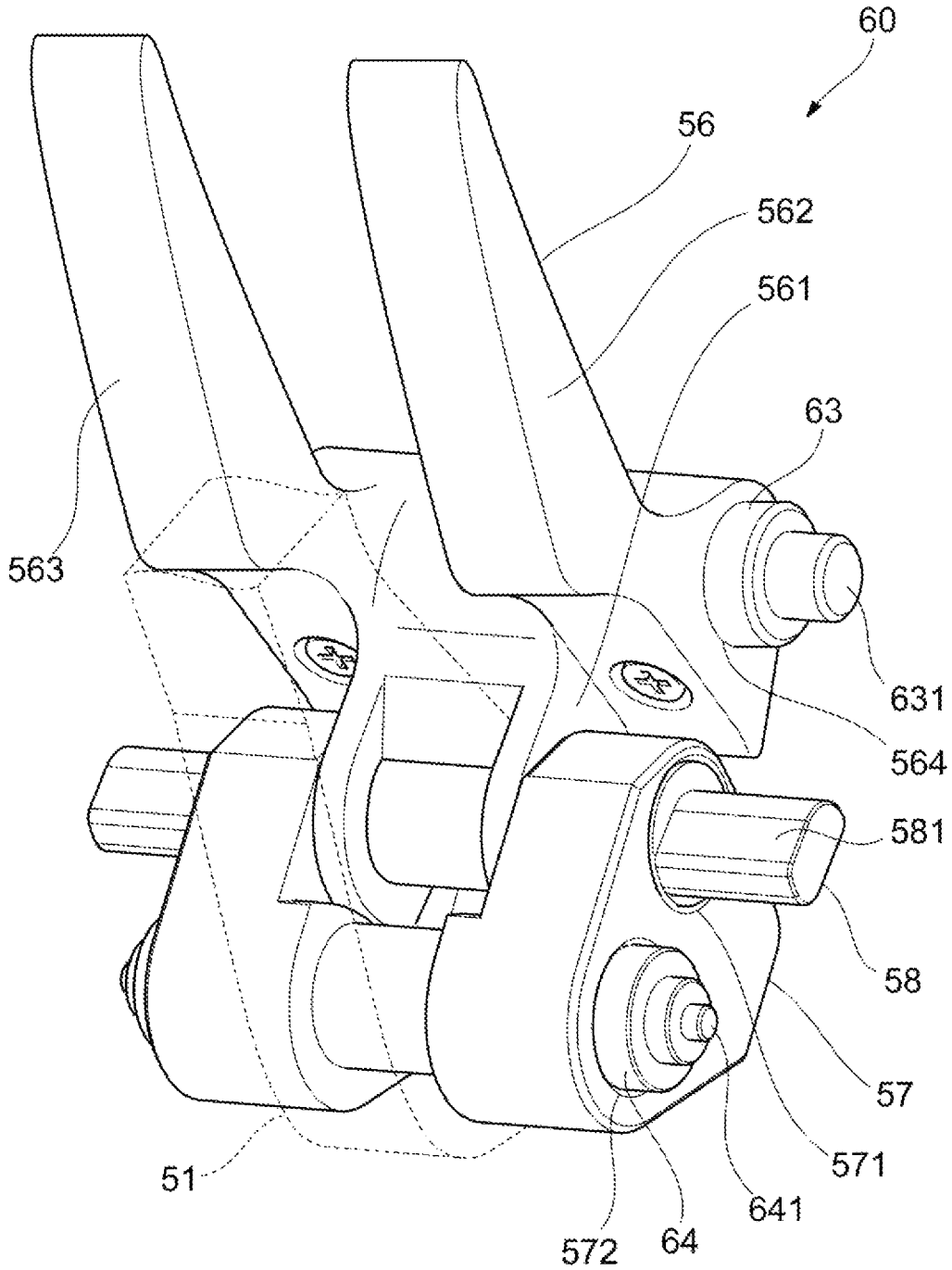
FIG. 7 is a view for explaining a pressing structure of the binding unit according to the present exemplary embodiment.
Figure 8:
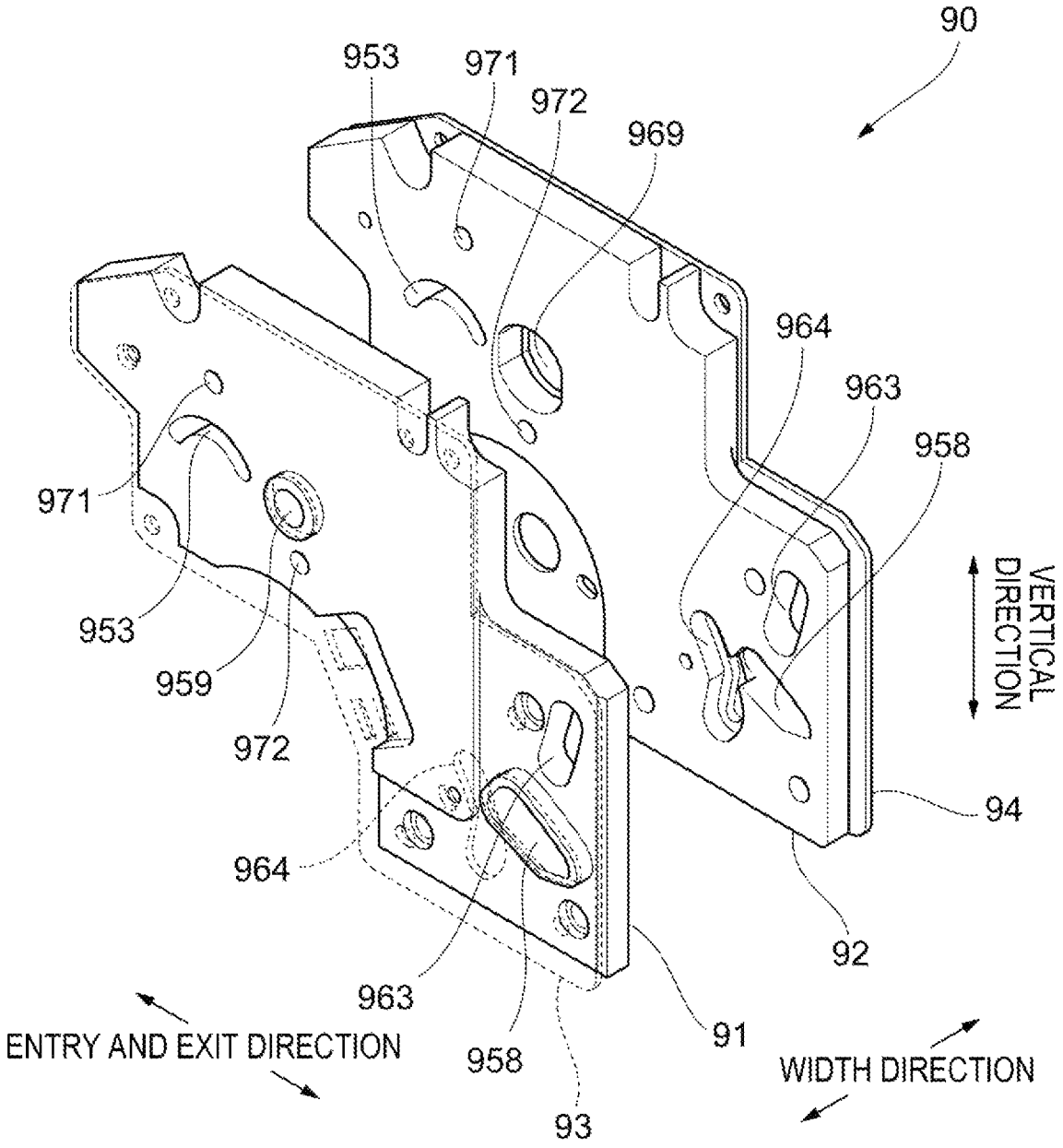
FIG. 8 is a view for explaining a case of the binding unit according to the present exemplary embodiment.
Figure 9:
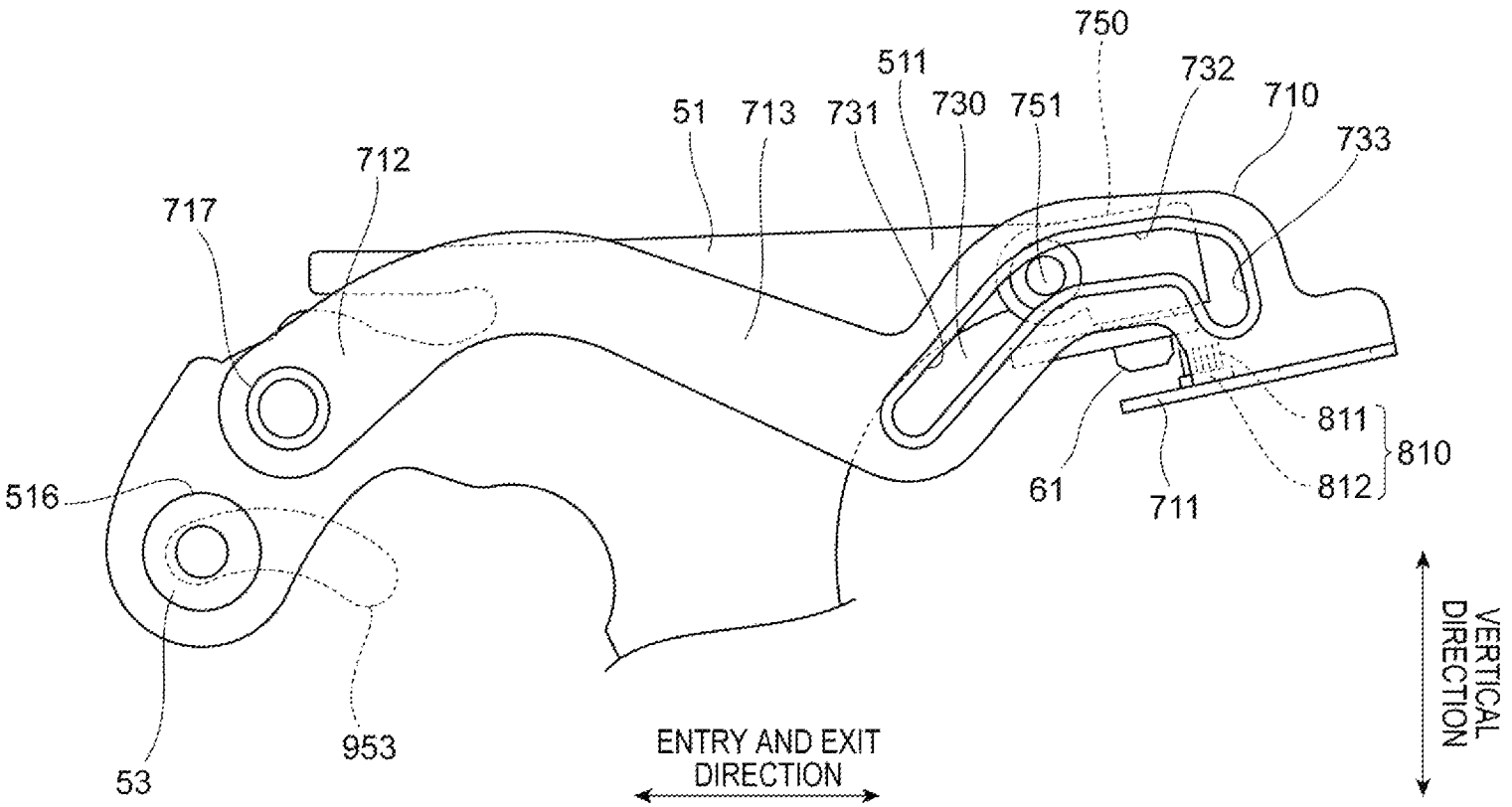
FIG. 9 is a view for explaining a configuration of a binding part, a second support part, and a cleaning part provided on the other side, in the thickness direction of the bundle of recording materials, of the binding unit according to the present exemplary embodiment.
Figure 10:
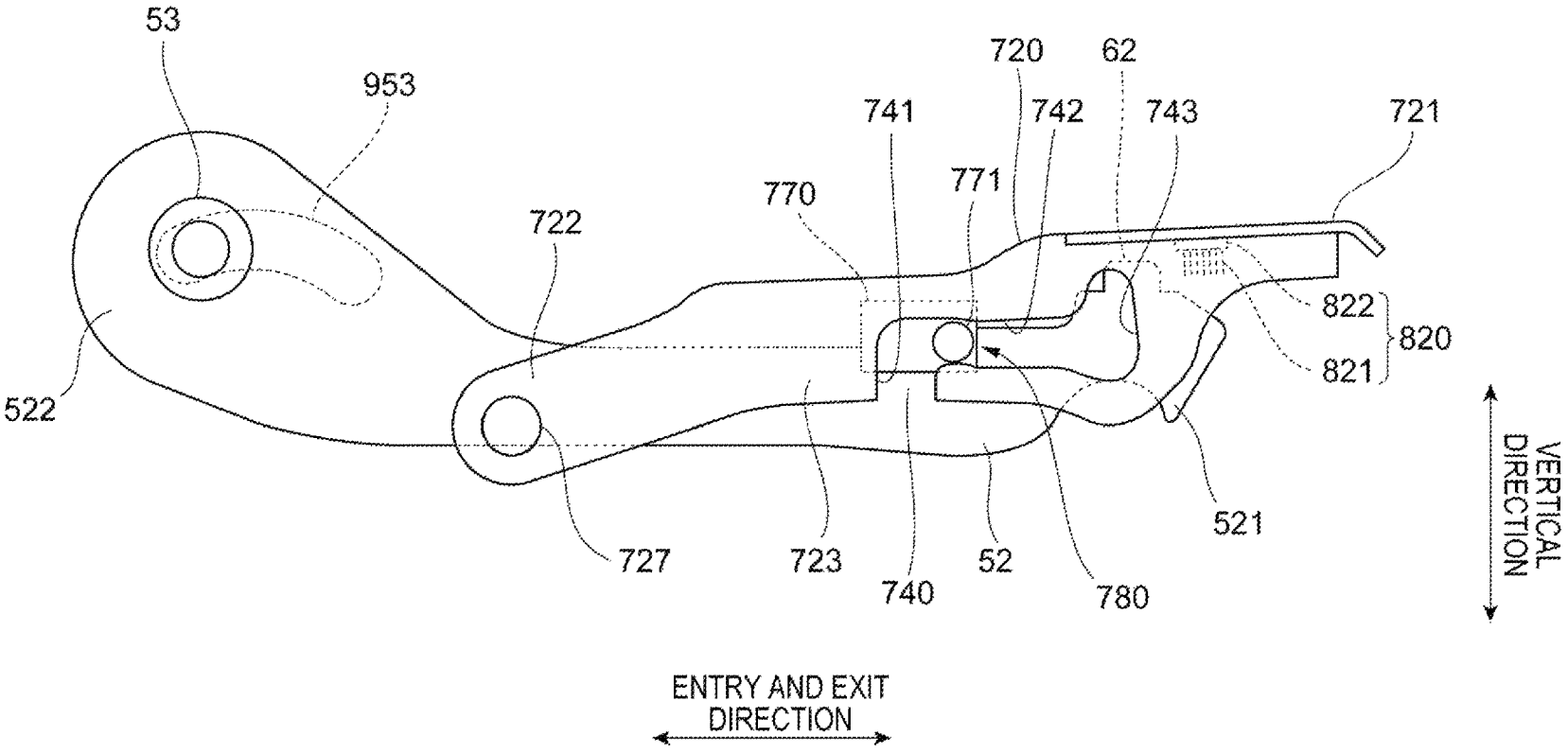
FIG. 10 is a view for explaining a configuration of a binding part, a first support part, and a cleaning part provided on one side, in the thickness direction of the bundle of recording materials, of the binding unit according to the present exemplary embodiment.
Figure 11:
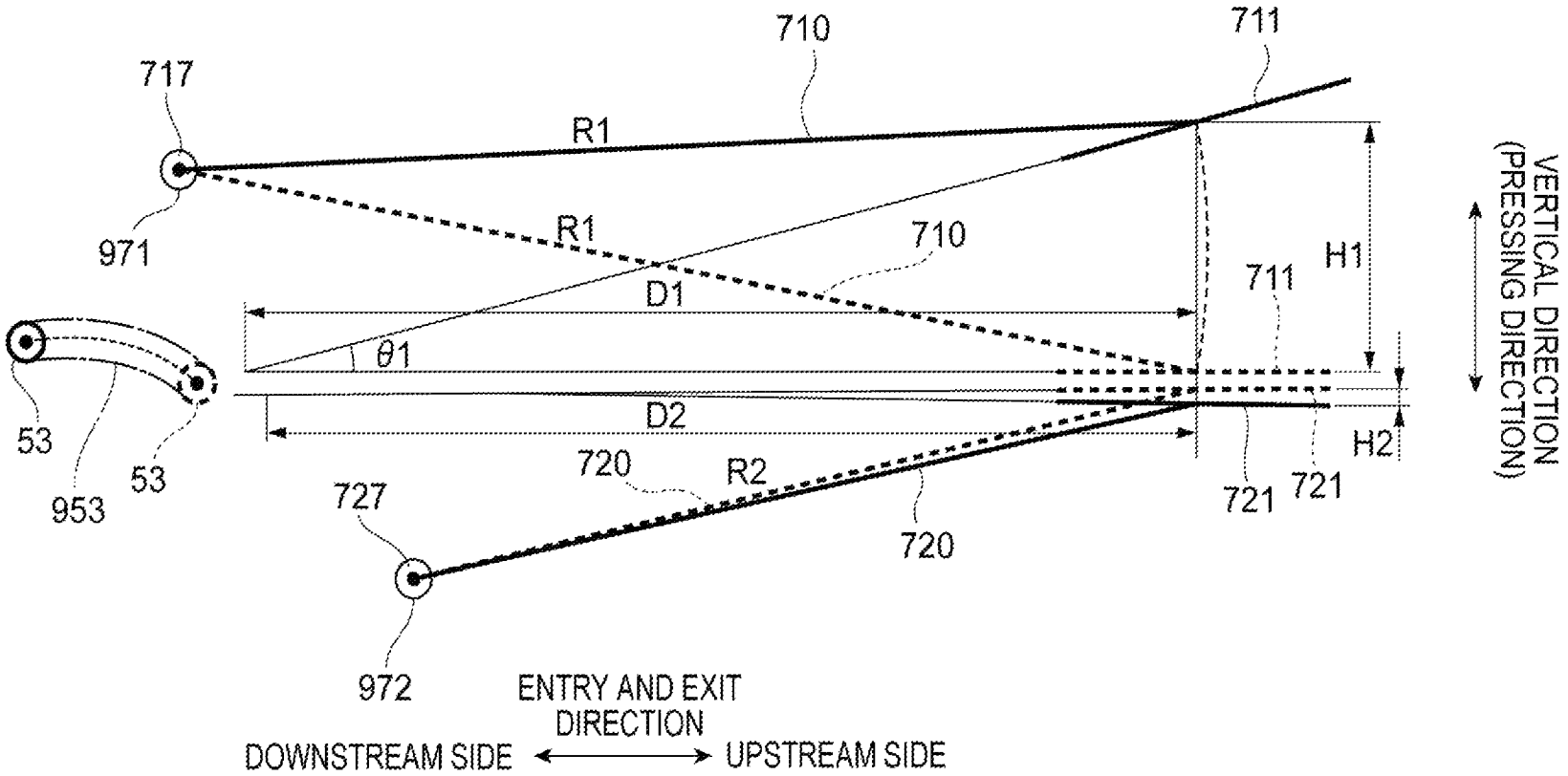
FIG. 11 is a conceptual view for explaining a configuration of the first support part and the second support part of the binding unit according to the present exemplary embodiment.

First, a structure of the binding unit 500 will be described with reference to FIGS. 4 to 11. FIG. 4 is a perspective view of the binding unit 500 according to the present exemplary embodiment. FIG. 5 is a view for explaining a binding structure 50 of the binding unit 500, and FIG. 6 is a view for explaining a binding assisting part 700 of the binding unit 500. In addition, FIG. 7 is a view for explaining an extruding link 60 in the binding structure 50 of the binding unit 500, and FIG. 8 is a view for explaining a case 90 of the binding unit 500. In addition, FIG. 9 is a view for explaining a configuration of an upper contact part 710 of the binding unit 500 and the periphery thereof, and FIG. 10 is a view for explaining a configuration of a lower contact part 720 of the binding unit 500 and the periphery thereof, and FIG. 11 is a conceptual view for explaining a structure of the upper contact part 710 and the lower contact part 720 of the binding unit 500.

As illustrated in FIG. 4, the binding unit 500 according to the present exemplary embodiment includes the binding structure 50 that binds a bundle of sheets without needles, the binding assisting part 700 that pushes the bundle of sheets placed on the sheet accumulation unit 70 (see FIG. 2) before a binding operation of the binding structure 50 is performed and also cleans paper dust adhering to the binding structure 50 before and after the binding operation of the binding structure 50 is performed, a drive part 800 that drives an operation of the binding structure 50 and the binding assisting part 700, and the case 90 that supports the binding structure 50, the binding assisting part 700, and the drive part 800.

In addition, in the following description, it is assumed that the width direction of the bundle of sheets illustrated in FIG. 3 is simply referred to as "width direction" and the thickness direction of the bundle of sheets is referred to as "vertical direction". In addition, it is assumed that the transport direction of the bundle of sheets to be transported is referred to as "entry and exit direction" and the direction where the binding structure 50 presses the bundle of sheets from one side and the other side in the thickness direction of the bundle of sheets is simply referred to as "pressing direction". Here, the "pressing direction" is the direction when pressing in the "vertical direction".

First, the binding structure 50 will be described with reference to FIGS. 4, 5, and 7.

The binding structure 50 includes an upper arm 51 that has upper teeth 61 at one end thereof for pressing and deforming the bundle of sheets in the thickness direction, and a lower arm 52 that has lower teeth 62 at one end thereof so as to face the upper teeth 61 for pressing and deforming the bundle of sheets in the thickness direction. In addition, the binding structure 50 includes a shaft arm 53 that connects the upper arm 51 and the lower arm 52 to each other. In addition, the binding structure 50 includes the extruding link 60 that moves the lower arm 52 in the vertical direction.

Here, the upper teeth 61 and/or the upper arm 51 function as a binding part present on the upper side (one side), and the lower teeth 62 and/or the lower arm 52 function as a binding part present on the lower side (the other side). In addition, the shaft arm 53 functions as a binding part fulcrum.

In addition, the upper teeth 61 and/or the upper arm 51 function as a pressing part and/or a toothed part present on the upper side (one side), and the lower teeth 62 and/or the lower arm 52 function as a pressing part and/or a toothed part present on the lower side (the other side). In addition, the shaft arm 53 functions as a part constituting a moving mechanism and a moving mounting part.

In addition, in the following description, the region in which the upper teeth 61 and the lower teeth 62 press the bundle of sheets is referred to as "pressing region", and the point of action when the upper teeth 61 and the lower teeth 62 are engaged with each other to press and bind the bundle of sheets is referred to as "pressing action point".

The upper arm 51 includes one end portion 511 having the upper teeth 61 and the other end portion 512 that is bent integrally from the end portion 511 so as to extend in a C-shaped form. In addition, the upper arm 51 includes a support portion 513 that supports the upper arm 51 in the vicinity of a bending point between the end portion 511 and the other end portion 512, which are bent to each other.

The other end portion 512 includes a link connecting hole 515 that serves as a starting point for extruding the lower arm 52 toward the upper arm 51 by the extruding link 60. A shaft lever lower 64 (to be described later) is inserted into the link connecting hole 515. The link connecting hole 515 and the shaft lever lower 64 serve as a starting point part of movement of the extruding link 60. In addition, a rotation center hole 516 (see FIG. 9), which serves as the rotation center of the upper arm 51, is provided in the support portion 513.

The lower arm 52 has an arm structure, and includes one end portion 521 having the lower teeth 62 and the other end portion 522 extending substantially in one direction from the end portion 521.

A recess 523 is provided in the end portion 521 side having the lower teeth 62 so as to face the point of action of the extruding link 60 for extruding the lower arm 52 toward the upper arm 51. A shaft lever upper 63 to be described later is provided at the point of action of the extruding link 60. Then, the recess 523 has a cross section that forms a curved shape having a diameter equal to or greater than that of the shaft lever upper 63. The recess 523 is provided in the end portion 521 of the lower arm 52 substantially vertically below a position having the lower teeth 62. The recess 523 and the shaft lever upper 63 are the point of action of movement of the extruding link 60.

A rotation center hole 526, which serves as the rotation center of the lower arm 52, is formed in the other end portion 522 of the lower arm 52, and is coaxial with the rotation center hole 516 (see FIG. 9), which is the rotation center of the upper arm 51, so that the lower arm 52 is rotatably held by the shaft arm 53. The shaft arm 53 has small-diameter portions 531 at both end portions thereof, and the small-diameter portions 531 are engaged with notches (arm guides 953), having an elongated hole shape, which are formed in the case 90 (a left guide 91 and a right guide 92).

Thereby, the shaft arm 53 is configured to be movable with a component of movement in the entry and exit direction to be described later, and holds the upper arm 51 and the lower arm 52 so as to be movable in the entry and exit direction (the direction where the bundle of sheets enters and exits). In addition, the shaft arm 53 functions as a pressing part fulcrum.

In addition, in the following description, the trajectory, along which the upper arm 51 and the upper teeth 61 and the lower arm 52 and the lower teeth 62 move along a binding path by the movement of the shaft arm 53, is simply referred to as "moving trajectory". In addition, among the movement of the upper arm 51 and the upper teeth 61 and the lower arm 52 and the lower teeth 62 along the binding path, movement in the pressing direction where the bundle of sheets is pressed is referred to as "pressing direction movement", and movement in the entry and exit direction with respect to the pressing region in which the bundle of sheets is pressed is referred to as "entry and exit direction movement".

Next, the extruding link 60, which operates from the link connecting hole 515 (see FIG. 5), as a starting point, provided in the upper arm 51 will be described with reference to FIGS. 4, 5, and 7.

The extruding link 60 in the binding structure 50 moves the lower arm 52 in the vertical direction by an extension/retreat operation of a lever 56 and a link 57. A spindle 58 is provided at a connection position (joint) of the lever 56 and the link 57.

The lever 56 includes a connecting portion 561 connected to the spindle 58 and a main body portion 562 extending from the connecting portion 561. One end of the main body portion 562 is provided with a contact surface 563, which comes into contact with a cam 54 to be described later, and the other end of the main body portion 562 is provided with a push-up portion 564, which pushes up the lower arm 52. The shaft lever upper 63, which comes into contact with the lower arm 52, is provided in the push-up portion 564. The shaft lever upper 63 has a cylindrical shape, and small-diameter portions 631 having a small diameter are formed on both end portions of the shaft lever upper 63 so as to be engaged with notches (push-up guides 963 to be described later) provided in guide members (the left guide 91 and the right guide 92 to be described later). The cylindrical shaft lever upper 63 is in contact with the recess 523 (see FIG. 5), having a curved shape, in the lower arm 52. With the contact between the cylindrical part and the curved part, a degree of freedom is given to the contact position.

The link 57 includes a connecting portion 571 provided on one end thereof, to which the spindle 58 is connected, and a starting point connecting portion 572 provided on the other end thereof, which is connected to the link connecting hole 515 in the upper arm 51 by the shaft lever lower 64. The starting point connecting portion 572 functions as a starting point of the extruding link 60, which is an extruding part, and the shaft lever upper 63 functions as the point of action of the extruding link 60. The extruding link 60 as the extruding part extrudes the end portion 521 of the lower arm 52 toward the end portion 511 of the upper arm 51 by changing the distance from the starting point, which is the starting point of extrusion, to the point of action.

The spindle 58 has a cylindrical shape, and plate-shaped portions 581, which are provided on both end portions of the spindle 58 and have a flat portion, are engaged with notches (spindle guides 958) provided in the guide members (the left guide 91 and the right guide 92).

The shaft lever lower 64, which connects the upper arm 51 and the extruding link 60 to each other, has a cylindrical shape, and small-diameter portions 641 are provided on both end portions of the cylinder so as to be engaged with notches (lower guides 964) provided in the guide members (the left guide 91 and the right guide 92).

Next, the binding assisting part 700 will be described with reference to FIGS. 4 and 6.

The binding assisting part 700 includes the upper contact part 710 that pushes the bundle of sheets from above in the thickness direction of the bundle of sheets and the lower contact part 720 that supports the bundle of sheets from below in the thickness direction of the bundle of sheets. The upper contact part 710 is provided with an upper teeth cleaning part 810 that cleans the upper teeth 61, and the lower contact part 720 is provided with a lower teeth cleaning part 820 that cleans the lower teeth 62. The upper teeth cleaning part 810 is provided on the upper contact part 710 such that the direction of a cleaning tip end has an upward component, and the lower teeth cleaning part 820 is provided on the lower contact part 720 such that the direction of a cleaning tip end has a downward component.

The upper contact part 710 can be moved in conjunction with the movement of the upper arm 51 by means of an upper connecting part 750 fixed to the upper arm 51, and is connected so as to be slidable with respect to the upper arm 51.

That is, the upper connecting part 750 functions as a connecting mechanism of the upper contact part 710 and the upper arm 51.

In addition, the other end of the upper contact part 710 is rotatably provided with respect to holes (guides 971), which are formed in the guide members (the left guide 91 and the right guide 92), by a rotation center shaft 717.

The rotation center shaft 717 is a mounting member fulcrum (rotation fulcrum) of the upper contact part 710.

In addition, the lower contact part 720 can be moved in conjunction with the movement of the lower arm 52 by means of a lower connecting part 770 fixed to the lower arm 52, and is connected so as to be slidable with respect to the lower arm 52.

That is, the lower connecting part 770 functions as a connecting mechanism of the lower contact part 720 and the lower arm 52.

In addition, the other end of the lower contact part 720 is rotatably provided with respect to holes (guide 972), which are formed in the guide members (the left guide 91 and the right guide 92), by a rotation center shaft 727.

The rotation center shaft 727 is a mounting member fulcrum (rotation fulcrum) of the lower contact part 720.

Next, the case 90 will be described with reference to FIGS. 4, 7 and 8.

The case 90 includes the left guide 91 and the right guide 92 that guide the movement of each structure of the binding unit 500, and a left case 93 and a right case 94 disposed respectively outside the left guide 91 and the right guide 92 to fix the left and right guides 91 and 92.

Each of the left guide 91 and the right guide 92 includes the spindle guide 958 that guides the movement of the plate-shaped portion 581 (see FIG. 7) of the spindle 58, and the push-up guide 963 that guides the movement of the small-diameter portion 631 of the shaft lever upper 63. In addition, each guide includes the lower guide 964 that guides the movement of the small-diameter portion 641 of the shaft lever lower 64 and the arm guide 953 that guides the movement of the small-diameter portion 531 of the shaft arm 53. In addition, each guide includes the guide 971 that rotatably supports the rotation center shaft 717 of the upper contact part 710 and the guide 972 that rotatably supports the rotation center shaft 727 of the lower contact part 720. In addition, each guide includes a cam rotation shaft hole 959 or 969 that rotatably supports a rotating shaft of the cam 54 to be described later.

The spindle guide 958, the push-up guide 963, the lower guide 964, and the arm guide 953 have an elongated hole shape, and permit the movement of a member in a direction along the elongated hole shape. Each elongated hole has an entry and exit direction component and/or a pressing direction (vertical direction) component, the push-up guide 963 and the lower guide 964 particularly permit the movement of a member in the vertical direction component, and the spindle guide 958 and the arm guide 953 particularly permit the movement of a member in the entry and exit direction component.

The guide 971 and the guide 972 are circular holes, the guide 971 rotatably supports the rotation center shaft 717 of the upper contact part 710, and the guide 972 rotatably supports the rotation center shaft 727 of the lower contact part 720. In addition, in the present exemplary embodiment, the guide 971 and the guide 972 are formed in the vicinity of the arm guide 953. Specifically, the guide 971 is formed above the arm guide 953 and between both ends of the arm guide 953 in the entry and exit direction, and the guide 972 is formed below the arm guide 953 and upstream of the most upstream end of the arm guide 953 in the entry and exit direction. Thus, the rotation center shaft 717 and the rotation center shaft 727 (rotation fulcrums) are located upstream of the shaft arm 53 in the entry and exit direction when the shaft arm 53 (pressing fulcrum) is engaged with the arm guide 953 and located on the most downstream side of the arm guide 953 in the entry and exit direction.

In this way, the upper contact part 710 and the lower contact part 720, which perform rotation by the guide 971 and the guide 972 as circular holes, have a movement trajectory different from that of the upper arm 51 and the lower arm 52, which are moved by the arm guide 953 having an elongated hole shape. As a result, the upper contact part 710 and the lower contact part 720, on which the cleaning parts to be described later are provided, have a movement trajectory different from that of the binding parts having the upper teeth 61 and the lower teeth 62. By utilizing the difference between the movement trajectories, it is possible to clean the upper teeth 61 and the lower teeth 62.

The drive part 800 functions as a component of the moving mechanism. As illustrated in FIG. 4, the drive part 800 includes a motor 83 as a driving source and gears 84 that transmit driving. In addition, the binding unit 500 includes the cam 54 for making non-uniform movements, and a rotating shaft that transmits a drive force obtained from the motor 83 via the gears 84 to the cam 54. In the present exemplary embodiment, the shaft arm 53 and the extruding link 60 (the contact surface 563 of the lever 56) come into contact with the cam 54, and perform a predetermined movement according to the shape of the cam 54.

As illustrated in FIG. 4, the cam 54 is coaxially formed with two eccentric cams having different outer diameters in the width direction (the thickness direction of the cam 54). The two eccentric cams have cam valley portions having the same amount of eccentricity and cam crest portions having different amounts of eccentricity.

<Further Detailed Description of Binding Assisting Part 700>

Next, a configuration of the binding assisting part 700 will be described in more detail with reference to FIGS. 4 to 6, 9 and 10.

The upper contact part 710, which constitutes the binding assisting part 700, functions as a first support part that supports a bundle of sheets from above (one side), and also functions as a regulating mechanism.

In addition, the upper contact part 710 functions as a sheet pushing member, and also functions as a mounting member, a mounting mechanism, and a connecting mechanism, on which the upper teeth cleaning part 810 is provided.

The upper contact part 710 has an arm structure, and includes one end portion 711 that supports the upper teeth cleaning part 810, the other end portion 712 that extends substantially in one direction from the end portion 711, and a central portion 713 that connects the end portion 711 and the other end portion 712 to each other. In addition, as illustrated in FIG. 6, a notch 714 is provided in a center portion in the width direction of the upper contact part 710 to permit the vertical movement of the binding structure 50.

As illustrated in FIG. 6, the end portion 711 of the upper contact part 710 functions as a first support part that supports a bundle of sheets from above (one side), and is formed with a flat surface that extends in the width direction and the entry and exit direction so as to push the bundle of sheets from above. The upper teeth cleaning part 810 is provided downstream of the end portion 711 in the entry and exit direction, and a notch 715 is provided upstream of the end portion 711 in the entry and exit direction to permit the movement of the upper teeth 61 in the vertical direction.

The rotation center shaft 717, which serves as the rotation center (rotation fulcrum) of the upper contact part 710, is provided on the other end portion 712 of the upper contact part 710.

The rotation center shaft 717 functions as a predetermined fulcrum (rotation fulcrum) of the upper contact part 710 (first support part).

In addition, the rotation center shaft 717 functions as a connection mounting part and a mounting member fulcrum.

Here, the upper contact part 710 is not formed in a straight line from the end portion 711 to the other end portion 712, but the central portion 713 has multiple bending points and is formed in a substantially M-shaped form. Then, a linkage groove 730 is formed in an upstream side portion (a portion close to the end portion 711) of the central portion 713 in the entry and exit direction. The upper connecting part 750 is fixed to the end portion 511 of the upper arm 51, and a cylindrical small-diameter portion 751 provided on the upper connecting part 750 is inserted into the linkage groove 730. Thereby, the upper contact part 710 is connected to the upper arm 51 so as to be movable in conjunction with the movement of the upper arm 51.

The linkage groove 730 includes a mounting groove 731 as a groove for the insertion of the small-diameter portion 751 of the upper connecting part 750, a parallel groove 732 as a groove that extends from the mounting groove 731 to the end portion 711 side (the upstream side in the entry and exit direction) and that is formed substantially parallel to a flat surface of the end portion 711 extending in the entry and exit direction, and an orthogonal groove 733 as a groove that extends from the parallel groove 732 and is bent at the end portion 711 side so as to have a component in the pressing direction and that is formed in a direction substantially orthogonal to the flat surface of the end portion 711. Here, the linkage groove 730 functions as a regulating mechanism. In addition, the parallel groove 732 functions as a transmission groove, and the orthogonal groove 733 functions as a regulating groove.

The small-diameter portion 751 of the upper connecting part 750 moves along the mounting groove 731, the parallel groove 732, and the orthogonal groove 733 of the linkage groove 730. The end portion 511 and the upper teeth 61 of the upper arm 51 move similarly to the movement of the small-diameter portion 751. Then, when the end portion 511 and the upper teeth 61 of the upper arm 51 move along the parallel groove 732, the movement in the pressing direction having a component in the pressing direction is regulated by the parallel groove 732. In addition, the small-diameter portion 751 enters the orthogonal groove 733 from the parallel groove 732 and moves along the orthogonal groove 733. That is, this is equal to that the movement in the entry and exit direction, having a component in the entry and exit direction, of the end portion 511 and the upper teeth 61 of the upper arm 51 is regulated by the orthogonal groove 733.

Thereafter, the upper teeth 61 of the upper arm 51 move and reach a binding position, thereby coming into contact with the bundle of sheets. At this time, the small-diameter portion 751, which is in the orthogonal groove 733, is not located at the lowermost end of the orthogonal groove 733, but is located at the middle position of the orthogonal groove 733 having a margin, that is, between the uppermost end and the lowermost end of the orthogonal groove 733 in the pressing direction. Therefore, when the upper teeth 61 come into contact with the bundle of sheets, a margin is given for the upper contact part 710, which has been in contact with the bundle of sheets, to move far away from the bundle of sheets (upward in the pressing direction). That is, when the upper teeth 61 are strongly pressed against the bundle of sheets, the periphery of a position, at which the bundle of sheets is pushed, rises, so that a rising force is also applied to the upper contact part 710. However, since the length of the orthogonal groove 733 has a margin, the rising of the upper contact part 710 is permitted, and the pressing by the upper teeth 61 is not disturbed.

The lower contact part 720 functions as a second support part that supports the bundle of sheets from below (the other side), and also functions as a regulating mechanism.

In addition, the lower contact part 720 functions as a sheet pushing member, and also functions as a mounting member, a mounting mechanism, or a connecting mechanism that mounts the lower teeth cleaning part 820.

The lower contact part 720 has an arm structure, and includes one end portion 721 that supports the lower teeth cleaning part 820, the other end portion 722 that extends in one direction from the end portion 721, and a central portion 723 that connects the end portion 721 and the other end portion 722 to each other. In addition, as illustrated in FIG. 6, a notch 724 is provided in a central portion in the width direction of the lower contact part 720 to permit the vertical movement of the binding structure 50.

As illustrated in FIG. 6, the end portion 721 of the lower contact part 720 functions as a second support part that supports the bundle of sheets from below (the other side), and is formed with a flat surface that extends in the width direction and in the entry and exit direction so as to push the bundle of sheets from below. Then, the lower teeth cleaning part 820 is provided downstream of the end portion 721 in the entry and exit direction, and a notch 725 is provided upstream of the end portion 721 in the entry and exit direction to permit the vertical movement of the lower teeth 62.

The other end portion 722 of the lower contact part 720 is provided with the rotation center shaft 727, which serves as the rotation center (rotation fulcrum) of the lower contact part 720.

The rotation center shaft 727 functions as a predetermined fulcrum (rotation fulcrum) of the lower contact part 720 (second support part).

In addition, the rotation center shaft 727 functions as a connection mounting part and a mounting member fulcrum.

A linkage groove 740 is formed in the central portion 723 of the lower contact part 720 in an upstream side portion (a portion close to the end portion 721) in the entry and exit direction. The lower connecting part 770 is fixed to the end portion 521 of the lower arm 52, and a small-diameter portion 771, which is provided on the lower connecting part 770 and has a cylindrical shape, is inserted into the linkage groove 740. Thereby, the lower contact part 720 is connected to the lower arm 52 so as to be movable in conjunction with the movement of the lower arm 52.

The linkage groove 740 includes a mounting groove 741 as a groove for the insertion of the small-diameter portion 771 of the lower connecting part 770, a parallel groove 742 as a groove that extends from the mounting groove 741 to the end portion 721 side and that is formed substantially parallel to a flat surface of the end portion 721 extending in the entry and exit direction, and an orthogonal groove 743 as a groove that extends from the parallel groove 742 and is bent at the end portion 721 side and that is formed in a direction substantially orthogonal to the flat surface of the end portion 721. Here, the linkage groove 740 functions as a regulating mechanism. In addition, the parallel groove 742 functions as a transmission groove, and the orthogonal groove 743 functions as a regulating groove.

The small-diameter portion 771 of the lower connecting part 770 (the end portion 521 and the lower teeth 62 of the lower arm 52) moves along the mounting groove 741, the parallel groove 742, and the orthogonal groove 743 of the linkage groove 740. The end portion 521 and the lower teeth 62 of the lower arm 52 move similarly to the movement of the small-diameter portion 771. Then, when the end portion 521 and the lower teeth 62 of the lower arm 52 move along the parallel groove 742, the movement in the pressing direction having a component in the pressing direction is regulated by the parallel groove 742. In addition, the small-diameter portion 771 enters the orthogonal groove 743 from the parallel groove 742, and moves along the orthogonal groove 743. That is, this is equal to that the movement in the entry and exit direction, having a component in the entry and exit direction, of the end portion 521 and the lower teeth 62 of the lower arm 52 is regulated by the orthogonal groove 743.

Thereafter, the lower teeth 62 of the lower arm 52 move and reach a binding position, and come into contact with the bundle of sheets. At this time, the small-diameter portion 771, which is in the orthogonal groove 743, is not located at the uppermost end of the orthogonal groove 743, but is located at the middle position of the orthogonal groove 743 having a margin, that is, between the uppermost end and the lowermost end of the orthogonal groove 743 in the pressing direction. Therefore, when the lower teeth 62 come into contact with the bundle of sheets, a margin is given for the lower contact part 720, which has been in contact with the bundle of sheets, to move in a direction far away from the bundle of sheets (downward in the pressing direction). That is, when the lower teeth 62 are strongly pressed against the bundle of sheets, the periphery of a position, at which the bundle of sheets is pushed, rises, so that a rising force is also applied to the lower contact part 720. However, since the length of the orthogonal groove 743 has a margin, the downward movement of the lower contact part 720 due to the rising of the bundle of sheets is permitted, and the pressing by the lower teeth 62 is not disturbed.

<Configuration of Upper Teeth Cleaning Part 810 and Lower Teeth Cleaning Part 820>

The upper teeth cleaning part 810 includes a tip end 811 for cleaning the upper teeth 61 and a mounting end 812 for the mounting to the end portion 711 of the upper contact part 710. In the present exemplary embodiment, the upper teeth cleaning part 810 is formed by a brush structure, and the tip end 811 of the upper teeth cleaning part 810 faces upward to clean the upper teeth 61, which is formed in a toothed shape having teeth that extend downward in parallel with the entry and exit direction. At the time of cleaning, the tip end 811 of the upper teeth cleaning part 810, which is a brush structure, is bent by contact with the upper teeth 61, thereby removing paper dust adhering to the upper teeth 61.

The upper teeth cleaning part 810 is located upstream of the upper teeth 61 in the entry and exit direction, in a state where the upper arm 51 and the lower arm 52 are opened away from each other before the bundle of sheets is transported. Then, the upper teeth cleaning part 810 comes into contact with the upper teeth 61 while the upper arm 51 and the lower arm 52 perform a binding operation. Thereafter, when the bundle of sheets is pushed by the upper contact part 710 and the lower contact part 720, the upper teeth cleaning part 810 is located downstream of the upper teeth 61 in the entry and exit direction.

The lower teeth cleaning part 820 includes a tip end 821 for cleaning the lower teeth 62 and a mounting end 822 for the mounting to the end portion 721 of the lower contact part 720. In the present exemplary embodiment, the lower teeth cleaning part 820 is formed by a brush structure, and the tip end 821 of the lower teeth cleaning part 820 faces downward to clean the lower teeth 62, which is formed in a toothed shape having teeth that extend upward in parallel with the entry and exit direction. At the time of cleaning, the tip end 821 of the lower teeth cleaning part 820, which is a brush structure, is bent by contact with the lower teeth 62, thereby removing paper dust adhering to the lower teeth 62.

The lower teeth cleaning part 820 is located upstream of the lower teeth 62 in the entry and exit direction in a state where the upper arm 51 and the lower arm 52 are opened away from each other before the bundle of sheets is transported. Then, the lower teeth cleaning part 820 comes into contact with the lower teeth 62 while the upper arm 51 and the lower arm 52 perform a binding operation. Thereafter, when the bundle of sheets is pressed by the upper contact part 710 and the lower contact part 720, the lower teeth cleaning part 820 is located downstream of the lower teeth 62 in the entry and exit direction.

In addition, in the present exemplary embodiment, the upper teeth cleaning part 810 and the lower teeth cleaning part 820 are formed by the brush structure, but, instead of the brush structure, for example, the upper teeth cleaning part 810 and the lower teeth cleaning part 820 may be formed by a sheet metal structure in which bending is formed according to a tooth form. With this sheet metal structure, at the time of cleaning, the tip end 811 of the upper teeth cleaning part 810 is bitten by the upper teeth 61 in accordance with the toothed shape of the upper teeth 61, whereby the upper teeth cleaning part 810 removes paper dust adhering to the upper teeth 61. In addition, the tip end 821 of the lower teeth cleaning part 820 is bitten by the lower teeth 62 in accordance with the toothed shape of the lower teeth 62, whereby the lower teeth cleaning part 820 removes paper dust adhering to the lower teeth 62.

<Configuration of Upper Contact Part 710 and Lower Contact Part 720>

Subsequently, a configuration of the upper contact part 710 and the lower contact part 720 will be described with reference to FIG. 11.

The rotation center shaft 717 of the upper contact part 710, that is, the fulcrum of the upper contact part 710 is positioned by the guide 971, which is a circular hole provided in the case 90 (see FIG. 4). As described above, the guide 971 is formed above the arm guide 953 and between both ends of the arm guide 953 in the entry and exit direction, and the rotation center shaft 717 of the upper contact part 710 (the fulcrum of the upper contact part 710) also has the same positional relationship as the guide 971.

The position of the end portion 711 of the upper contact part 710 moves on a circular arc, which is a portion of the circle having a radius R1 about the rotation center shaft 717, by the rotation of the upper contact part 710. As illustrated in FIG. 11, "R1" is the length from the rotation center shaft 717 to the center of the flat surface of the end portion 711 that is in contact with and presses the bundle of sheets (hereinafter, the center of the flat surface of the end portion 711 being simply referred to as "the end portion 711").

Similarly, the rotation center shaft 727 of the lower contact part 720, that is, the fulcrum of the lower contact part 720 is positioned by the guide 972, which is a circular hole provided in the case 90 (see FIG. 4). As described above, the guide 972 is formed below the arm guide 953 and upstream of the most upstream end of the arm guide 953 in the entry and exit direction, and the rotation center shaft 727 of the lower contact part 720 (the fulcrum of the lower contact part 720) also has the same positional relationship as the guide 972.

The position of the end portion 721 of the lower contact part 720 moves on a circular arc, which is a portion of the circle having a radius R2 about the rotation center shaft 727, by the rotation of the lower contact part 720. As illustrated in FIG. 11, "R2" is the length from the rotation center shaft 727 to the center of the flat surface of the end portion 721 that is in contact with and presses the bundle of sheets (hereinafter, the center of the flat surface of the end portion 721 being simply referred to as "the end portion 721"). In addition, "R2" is shorter than "R1".

Subsequently, a positional relationship between the end portion 711 of the upper contact part 710 and the end portion 721 of the lower contact part 720 will be described in detail based on an initial state thereof and a pushing state where they push the bundle of sheets separately.

Here, the initial state is a state where the shaft arm 53 is located on the most downstream side of the arm guide 953 in the entry and exit direction and the opening of the upper contact part 710 and the lower contact part 720 is maximized, as indicated by the solid line in FIG. 11. In addition, the pushing state is a state, as shown by the broken line in FIG. 11, where the shaft arm 53 is located on the most upstream side of the arm guide 953 in the entry and exit direction and the end portion 711 of the upper contact part 710 and the end portion 721 of the lower contact part 720 push the bundle of sheets from both sides in the thickness direction of the bundle of sheets.

In the initial state, both the rotation center shaft 717 and the rotation center shaft 727 are located upstream of the shaft arm 53. In addition, the flat surface of the end portion 711 of the upper contact part 710 is inclined upward. Here, the inclination rate of the flat surface of the end portion 711 of the upper contact part 710 is set to H1/D1. In addition, when setting the inclination rate, "H1" is the distance in the vertical direction from the initial state to the pushing state of the end portion 711. In addition, when setting the inclination rate, "D1" is the distance of the end portion 711 in the entry and exit direction when the flat surface of the end portion 711 in the initial state is extended. In addition, as illustrated in FIG. 11, "D1" is longer than "H1", and "D1" is about 4 times "H1". Therefore, the value of H1/D1 is about ¼, and the angle θ1 (inclination rate) at which the end portion 711 is inclined from the shaft arm 53 is about 14° with respect to the entry and exit direction. The inclination rate of about 14° may be interpreted to be small in consideration of the size H1 of an opening defined by the end portion 711 of the upper contact part 710. That is, since the inclination rate of the end portion 711 of the upper contact part 710 is small, the end portion 711 of the upper contact part 710 is in a state of being relatively close to a parallel state with respect to the entry and exit direction.

In addition, the end portion 721 of the lower contact part 720 is inclined downward. At this time, the inclination rate of the end portion 721 of the lower contact part 720 is set to H2/D2. In addition, as illustrated in FIG. 11, "D2" is extremely long compared with "H2", and for example, "D2" is about 65 times as large as "H2". Therefore, the value of H2/D2, which is the inclination rate of the end portion 721 of the lower contact part 720, is close to 0, and the end portion 711 of the upper contact part 710 is in a state of being nearly parallel to the entry and exit direction.

On the other hand, in the pushing state, the shaft arm 53 moves to the upstream side in the entry and exit direction. In this moved state, the rotation center shaft 717 is located downstream of the shaft arm 53, and the rotation center shaft 727 is located upstream of the shaft arm 53. In addition, the flat surface of the end portion 711 of the upper contact part 710 and the flat surface of the end portion 721 of the lower contact part 720 push the bundle of sheets in a state of being parallel to the entry and exit direction.

In a process of shifting from the initial state to the pushing state described above, the flat surface of the end portion 711 of the upper contact part 710 becomes the pushing state in a state of being nearly parallel to the entry and exit direction, and the flat surface of the end portion 721 of the lower contact part 720 becomes the pushing state in a state of being extremely parallel to the entry and exit direction. Therefore, although the end portion 711 of the upper contact part 710 and the end portion 721 of the lower contact part 720 are brought closer to each other by rotation, the flat portions of the two may push the bundle of sheets while remaining in a state of being nearly parallel to the entry and exit direction.

In addition, here, the vertical movement amount H2 of the end portion 721 of the lower contact part 720 is smaller than the vertical movement amount H1 of the end portion 711 of the upper contact part 710. Therefore, the rotation center shaft 717 of the upper contact part 710 is provided downstream of the rotation center shaft 727 of the lower contact part 720 in the entry and exit direction. In other words, the pushing positions in the entry and exit direction at the end portion 711 of the upper contact part 710 and the end portion 721 of the lower contact part 720 are the same, and the length R2 of the lower contact part 720 is shorter than the length R1 of the upper contact part 710.

In addition, in order to cause the initial state of the end portion 711 of the upper contact part 710 to be close to state of being nearly parallel to the entry and exit direction, it is necessary to reduce the inclination rate (H1/D1) of the end portion 711. To this end, it is necessary to shorten "H1" and/or to lengthen "D1".

Here, as described above, the movement of the end portion 711 of the upper contact part 710 is in conjunction with the movement of the end portion 511 of the upper arm 51, and the movement of the end portion 511 of the upper arm 51 is performed according to the movement of the shaft arm 53 connected thereto. Therefore, the end portion 711 of the upper contact part 710 moves in conjunction with the movement of the shaft arm 53. Therefore, in order to shorten "H1", in the initial state, the shaft arm 53 may be disposed downstream of the rotation center shaft 717 of the upper contact part 710 in the entry and exit direction.

In addition, by lengthening "D1", the flat surface of the end portion 711 of the upper contact part 710 may move in the thickness direction of the bundle of sheets in a state of being more nearly parallel to the entry and exit direction, thereby pushing the bundle of sheets from above in the thickness direction thereof.

<Operation of Binding Unit 500>

Subsequently, an operation of the binding unit 500 according to the present exemplary embodiment will be described.

An operation of the binding unit 500 is performed by the movement of the cam 54 when the cam 54 receives driving of the motor 83 via the gears 84 under the control of the sheet processing controller 23. In the present exemplary embodiment, a single cam rotation by the cam 54 enables movement of the binding unit 500, that is, movement of the binding structure 50 and the binding assisting part 700.

Specifically, by the rotation of the cam 54, the cam 54 comes into contact with the shaft arm 53 and the extruding link 60. In this process, the cam 54 first comes into contact with the shaft arm 53, so that the shaft arm 53 moves from the downstream side toward the upstream side of the arm guide 953 (see FIG. 8) in the entry and exit direction according to a change in the shape of the cam 54. By this movement, the upper arm 51 and the lower arm 52 move from the retreat position to the projecting position (binding position), that is, perform movement from the downstream side to the upstream side in the entry and exit direction. Thereafter, the cam 54 releases the contact with the shaft arm 53, and starts to come into contact with the extruding link 60. By the contact with the extruding link 60, the extruding link 60 extends from the compressed state, so that the lower teeth 62 provided on the lower arm 52 are extruded toward the upper teeth 61 provided on the upper arm 51. On the other hand, the end portion 511 of the upper arm 51, on which the upper teeth 61 are provided, is extruded toward the lower arm 52 as the other end portion 512 of the upper arm 51 moves downward by the movement of the shaft lever lower 64. In this way, the upper arm 51 and the lower arm 52 perform vertical movement.

<Operation of Binding Assisting Part 700>

Figure 12A:
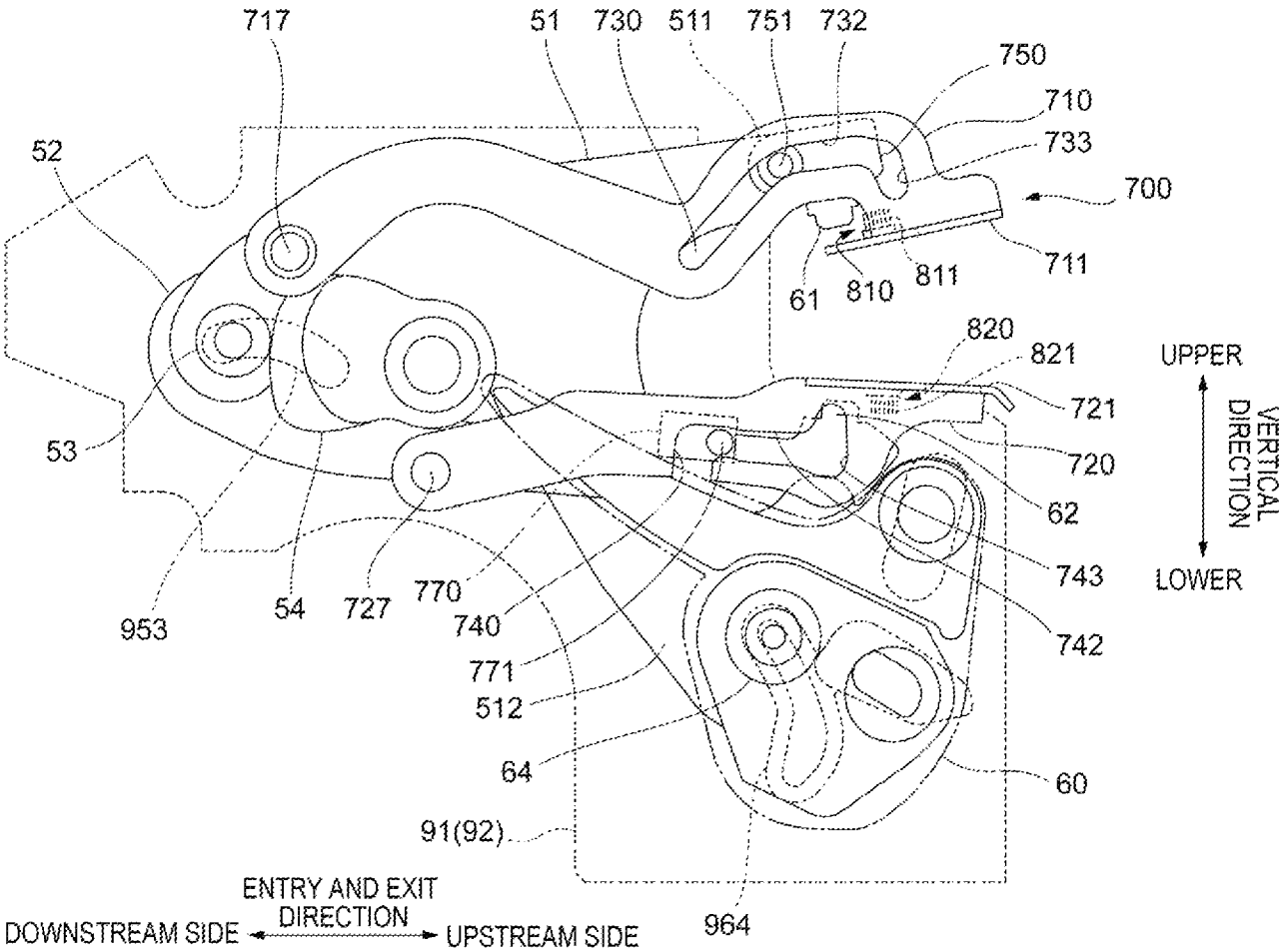
FIG. 12A is a view for explaining an initial state before the binding unit according to the present exemplary embodiment comes into contact with the bundle of recording materials.
Figure 12B:
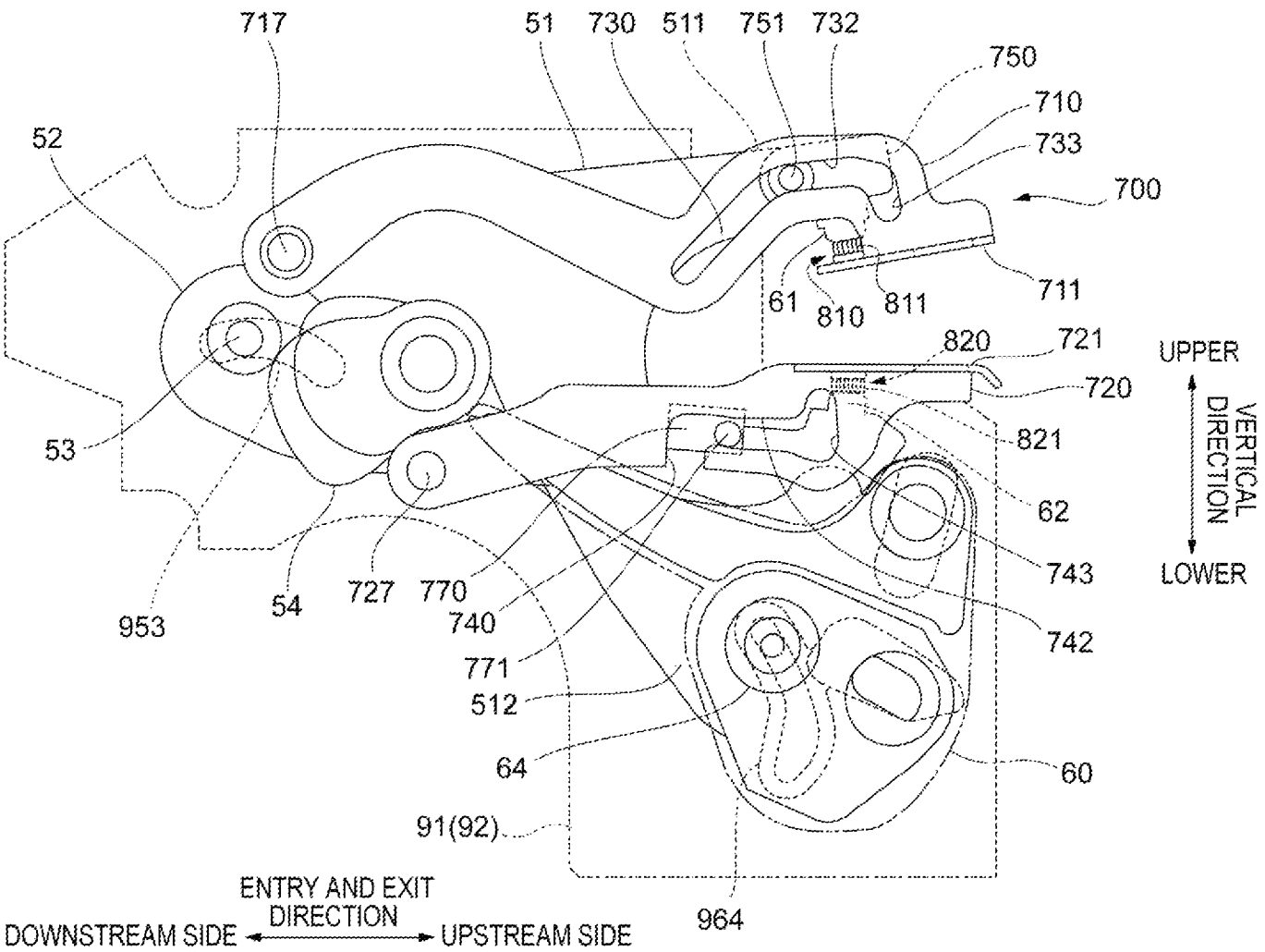
FIG. 12B is a view for explaining a state where the cleaning part of the binding unit according to the present exemplary embodiment cleans the binding part.
Figure 12C:
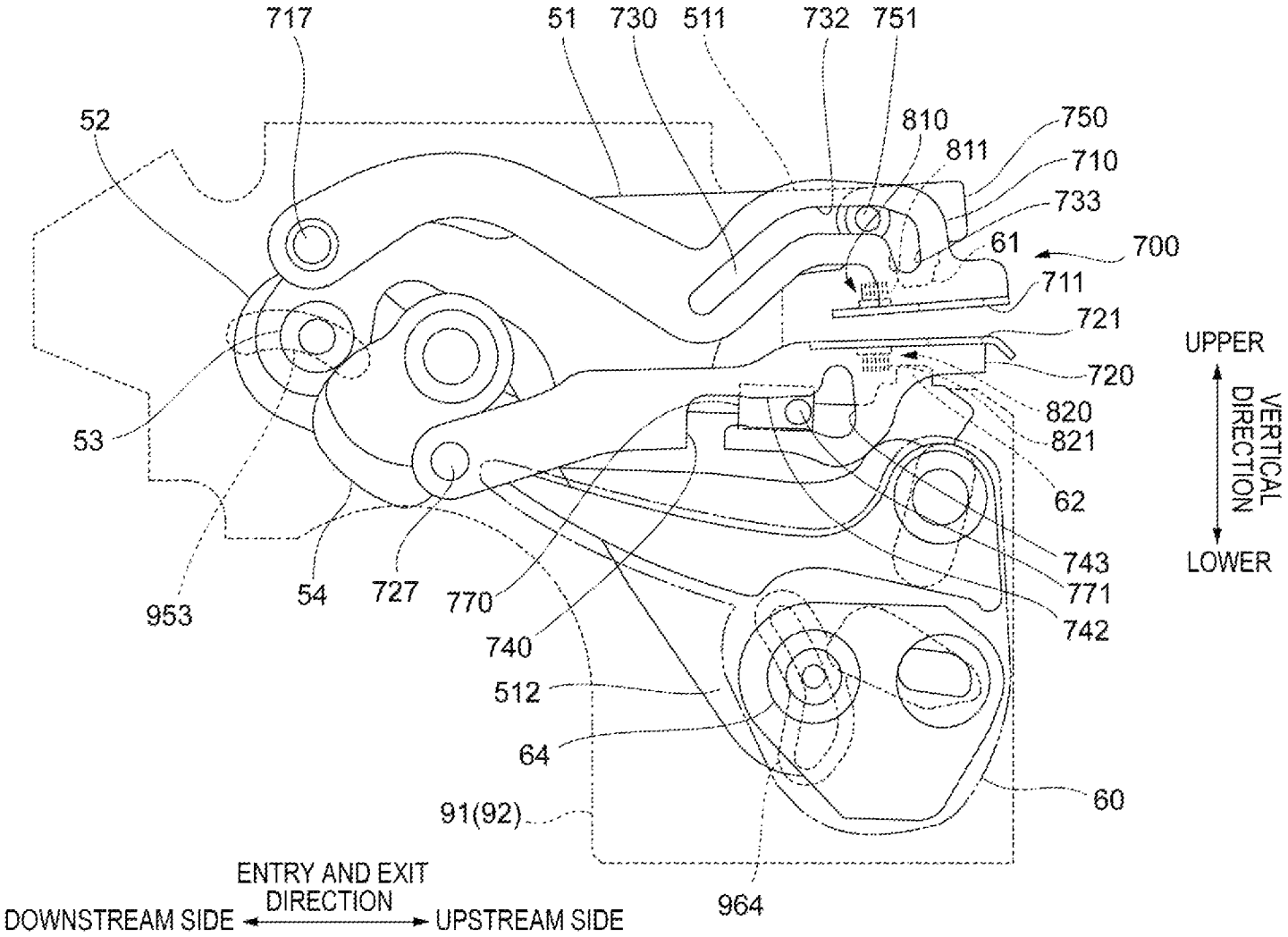
FIG. 12C is a view for explaining a state of the binding part, the first support part, the second support part, and the cleaning part immediately before the first support part and the second support part of the binding unit according to the present exemplary embodiment come into contact with the bundle of recording materials.
Figure 12D:
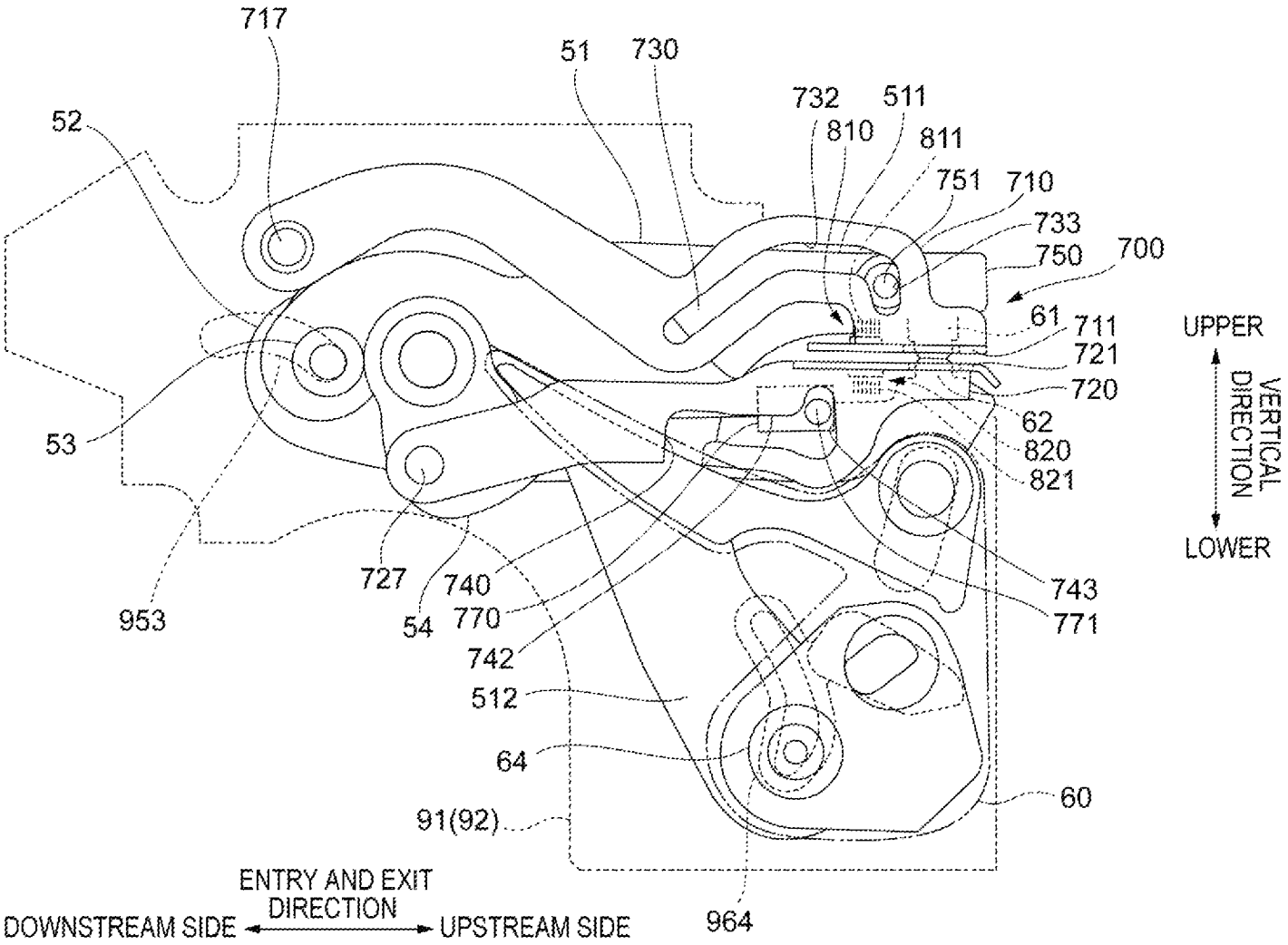
FIG. 12D is a view for explaining a state of the binding part, the first support part, the second support part, and the cleaning part when the first support part and the second support part of the binding unit according to the present exemplary embodiment come into contact with the bundle of recording materials.

Next, an operation of the binding assisting part 700 will be described in detail with reference to FIGS. 12A to 12D. FIG. 12A is a view for explaining an initial state before the binding assisting part 700 comes into contact with the bundle of sheets, and FIG. 12B is a view for explaining a state where the upper teeth cleaning part 810 and the lower teeth cleaning part 820 of the binding assisting part 700 clean the upper teeth 61 and the lower teeth 62. In addition, FIG. 12C is a view for explaining a state of the respective constituent elements of the binding assisting part 700 immediately before the upper contact part 710 and the lower contact part 720 of the binding assisting part 700 come into contact with the bundle of sheets, and FIG. 12D is a view for explaining the respective constituent elements of the binding assisting part 700 when the upper contact part 710 and the lower contact part 720 of the binding assisting part 700 come into contact with the bundle of sheets.

The binding assisting part 700 moves in conjunction with the movement of the upper arm 51 and the lower arm 52 described above. In an initial state of the binding assisting part 700 before the cam 54 starts to rotate, as illustrated in FIG. 12A, the crest portion (long diameter portion) of the cam 54 is in contact with the shaft arm 53, but is not in contact with the extruding link 60. In this initial state, the shaft arm 53 is pushed to the cam 54, so that the shaft arm 53 is located on the most downstream side of the arm guide 953 in the entry and exit direction. Thus, the upper arm 51 and the lower arm 52, supported by the shaft arm 53, are also located at the retreat position on the most downstream side in the entry and exit direction.

In addition, since the crest portion (long diameter portion) of the cam 54 and the extruding link 60 are not in contact with each other, the extruding link 60 is in the most compressed state. At this time, since the lower arm 52 is not in contact with the extruding link 60, the lower arm 52 is located at the lowermost position within a movable range thereof. On the other hand, at this time, the shaft lever lower 64 (the other end portion 512 of the upper arm 51) is located on the uppermost side of the lower guide 964 in the vertical direction, and the end portion 511 of the upper arm 51 is also located on the uppermost side within a movable range thereof. In this way, the opening of the upper arm 51 and the lower arm 52 is maximized.

In addition, at this time, the upper contact part 710 connected to the upper arm 51 is located, together with the upper arm 51, on the uppermost side within a movable range thereof. In addition, since the rotation center shaft 717 of the upper contact part 710 does not move in the entry and exit direction and the vertical direction, in a state where the shaft arm 53 is located on the most downstream end of the arm guide 953 in the entry and exit direction, the small-diameter portion 751 of the upper connecting part 750 is also located on the most downstream side of the parallel groove 732 in the upper contact part 710. Then, the end portion 711 of the upper contact part 710 is located most upstream of the upper teeth 61 (the end portion 511) in the entry and exit direction. In this case, the upper teeth cleaning part 810 provided on the end portion 711 is located upstream of the upper teeth 61 provided on the end portion 511 of the upper arm 51 in the entry and exit direction. In addition, at this time, cleaning is not started yet, and the upper teeth cleaning part 810 is not in contact the upper teeth 61.

Likewise, at this time, the lower contact part 720 connected to the lower arm 52 is located, together with the lower arm 52, on the lowermost side within a movable range thereof. In addition, since the rotation center shaft 727 of the lower contact part 720 does not move in the entry and exit direction and the vertical direction, in a state where the shaft arm 53 is located on the most downstream end of the arm guide 953 in the entry and exit direction, the small-diameter portion 771 of the lower connecting part 770 is also located on the most downstream side of the parallel groove 742 in the lower contact part 720. Then, the end portion 721 of the lower contact part 720 is located most upstream of the lower tooth 61 (the end portion 521) in the entry and exit direction. In this case, the lower teeth cleaning part 820 provided on the end portion 721 is located upstream of the lower teeth 62 provided on the end portion 521 of the lower arm 52 in the entry and exit direction. In addition, at this time, cleaning is not started yet, and the lower teeth cleaning part 820 is not in contact with the lower teeth 62.

Thereafter, by the rotation of the cam 54, as illustrated in FIG. 12B, a contact position of the cam 54 and the shaft arm 53 changes, so that the shaft arm 53 moves along the arm guide 953 toward the upstream side of the arm guide 953 in the entry and exit direction. Then, the upper arm 51 and the lower arm 52 move along a binding path. Specifically, the upper arm 51 and the lower arm 52 move toward the upstream side from the retreat state on the most downstream side in the entry and exit direction, so that the distance between the two facing each other is gradually shortened. At that time, the cam 54 is not in contact the extruding link 60, and the lower arm 52 is also not in contact the extruding link 60.

In addition, at this time, since the rotation center shaft 717 of the upper contact part 710 does not move in the entry and exit direction and the vertical direction, when the upper arm 51 moves toward the upstream side of the upper arm 51 in the entry and exit direction, the small-diameter portion 751 of the upper connecting part 750 moves toward the upstream side of the parallel groove 732 along the parallel groove 732 in the upper contact part 710, and the end portion 711 of the upper contact part 710 slides relative to the end portion 511 of the upper arm 51. At this time, since the upper teeth cleaning part 810 is provided on the end portion 711 of the upper contact part 710, the upper teeth cleaning part 810 slides from the upstream side to the downstream side in the entry direction of the entry and exit direction relative to the upper teeth 61 provided on the end portion 511 of the upper arm 51, thereby coming into contact with the upper teeth 61 and further sliding. In the process in which the upper teeth cleaning part 810 and the upper teeth 61 come into contact with each other and further slide, the tip end 811 of the upper teeth cleaning part 810 comes into contact with the upper teeth 61, so that the tip end 811 bends to clean the upper teeth 61.

Likewise, since the rotation center shaft 727 of the lower contact part 720 does not move in the entry and exit direction and the vertical direction, when the lower arm 52 moves toward the upstream side in the entry and exit direction, the small-diameter portion 771 of the lower connecting part 770 moves toward the upstream side of the parallel groove 742 along the parallel groove 742 in the lower contact part 720, and the end portion 721 of the lower contact part 720 slides relative to the end portion 521 of the lower arm 52. At this time, since the lower teeth cleaning part 820 is provided on the end portion 721 of the lower contact part 720, the lower teeth cleaning part 820 slides relative to the lower teeth 62 provided on the end portion 521 of the lower arm 52, thereby coming into contact with the lower teeth 62 and further sliding. In the process in which the lower teeth cleaning part 820 comes into contact with the lower teeth 62 and further slides, the tip end 821 of the lower teeth cleaning part 820 comes into contact with the lower teeth 62, so that the tip end 821 bends to clean the lower teeth 62.

Thereafter, by the rotation of the cam 54, as illustrated in FIG. 12C, a contact position of the cam 54 and the shaft arm 53 also changes, so that the shaft arm 53 further moves along the arm guide 953 to the upstream side of the arm guide 953 in the entry and exit direction. The upper arm 51 and the lower arm 52 also further move toward the upstream side from the position illustrated in FIG. 12B, so that the distance between the two facing each other is further shortened.

In addition, when the upper arm 51 moves toward the upstream side in the entry and exit direction, the small-diameter portion 751 of the upper connecting part 750, which is integrated with the upper arm 51, moves toward the upstream side of the parallel groove 732 in the entry and exit direction along the parallel groove 732 in the upper contact part 710. Therefore, the end portion 711 of the upper contact part 710 continues to slide relative to the end portion 511 of the upper arm 51. Thus, the upper teeth cleaning part 810 provided on the end portion 711 continues to slide relative to the upper teeth 61 provided on the end portion 511 of the upper arm 51, and shifts from the contact state to the separated state with respect to the upper teeth 61, and the cleaning of the upper teeth 61 before the binding processing of the upper teeth 61 and the lower teeth 62 is completed.

Likewise, when the lower arm 52 moves toward the upstream side in the entry and exit direction, the small-diameter portion 771 of the lower connecting part 770, which is integrated with the lower arm 52, moves toward the upstream side of the parallel groove 742 in the entry and exit direction along the parallel groove 742 in the lower contact part 720. Therefore, the end portion 721 of the lower contact part 720 continues to slide relative to the end portion 521 of the lower arm 52. Thus, the lower teeth cleaning part 820 provided on the end portion 721 continues to slide relative to the lower teeth 62 provided on the end portion 521 of the lower arm 52, and shifts from the contact state to the separated state with respect to the lower teeth 62, and the cleaning of the lower teeth 62 before the binding processing of the upper teeth 61 and the lower teeth 62 is completed.

Thereafter, by the further rotation of the cam 54, as illustrated in FIG. 12D, the crest portion (long diameter portion) of the cam 54 is not in contact with the shaft arm 53, the shaft arm 53 is located on the most upstream side of the arm guide 953 in the entry and exit direction, and the upper arm 51 and the lower arm 52 are in a state of protruding maximally to the upstream side in the entry and exit direction. On the other hand, the crest portion (long diameter portion) of the cam 54 comes into contact with the extruding link 60, and by the contact between the cam 54 and the extruding link 60, the extruding link 60 shifts from the compressed state to the extended state, thereby being connected to (coming into contact with) the lower arm 52 in the middle of extension. Then, by continuing to extend, the extruding link 60 extrudes the lower arm 52 upward. In the middle of extension after the extruding link 60 is connected to (comes into contact with) the lower arm 52, the lower contact part 720 moves upward (toward the lower surface of the bundle of sheets) in conjunction with the lower arm 52.

As the extruding link 60 extends, at this timing, the shaft lever lower 64 (the other end portion 512 of the upper arm 51) moves downward in the vertical direction of the lower guide 964, and the end portion 511 of the upper arm 51 also moves downward. In the process of downward movement of the end portion 511 of the upper arm 51, the upper contact part 710 moves downward (toward the upper surface of the bundle of sheets) in conjunction with the upper arm 51.

Then, by the further rotation of the cam 54, the end portion 711 of the upper contact part 710 and the end portion 721 of the lower contact part 720 first come into contact with the bundle of sheets before the upper teeth 61 provided on the end portion 511 of the upper arm 51 and the lower teeth 62 provided on the end portion 521 of the lower arm 52, thereby pushing the bundle of sheets.

In addition, in this case, the small-diameter portion 751 of the upper connecting part 750 enters the orthogonal groove 733 from the parallel groove 732 in the upper contact part 710, so that regulation of pressing direction movement having a component in the pressing direction by the parallel groove 732 of the small-diameter portion 751 is eliminated by the orthogonal groove 733. That is, the regulation in the pressing direction of the upper contact part 710 is eliminated by the small-diameter portion 751, and the upper contact part 710 pushes the bundle of sheets by the own weight.

Thereafter, when the cam 54 continues to rotate, the upper teeth 61 and the lower teeth 62 (the upper arm 51 and the lower arm 52) also move to close the opening thereof from the state of the middle of extension to the most extended state of the extruding link 60. That is, the upper teeth 61 move downward and the lower teeth 62 move upward.

At the time of the downward movement of the upper teeth 61 (the upper arm 51), the small-diameter portion 751 of the upper connecting part 750 moves along the orthogonal groove 733 in the upper contact part 710. Thereby, in a state where the upper contact part 710 is in contact with the bundle of sheets, the upper teeth 61 further move toward the bundle of sheets. Then, the upper teeth 61 also move downward and pass through the notch 715 (see FIG. 6) formed in the end portion 711 of the upper contact part 710, so as to start a binding operation of the bundle of sheets.

Likewise, at the time of upward movement of the lower teeth 62 (the lower arm 52), the small-diameter portion 771 of the lower connecting part 770 moves along the orthogonal groove 743 in the lower contact part 720. Thereby, in a state where the lower contact part 720 is in contact with the bundle of sheets, the lower teeth 62 also move toward the bundle of sheets. Then, the lower teeth 62 also move upward and pass through the notch 725 (see FIG. 6) formed in the end portion 721 of the lower contact part 720, so as to start a binding operation of the bundle of sheets.

Thereafter, by the further rotation of the cam 54, the upper teeth 61 are engaged with the lower teeth 62 to press and bind the bundle of sheets. When the upper teeth 61 and the lower teeth 62 come into contact with the bundle of sheets, the end portion 711 of the upper contact part 710 receives a rising force from a portion of the bundle of sheets, which has been pressed and raised by the upper teeth 61, that is, from the peripheral portion of a pushed portion of the bundle of sheets, thereby retreating far away from the bundle of sheets (upward in the pressing direction).

Likewise, along with the retreating movement of the end portion 711 of the upper contact part 710, the end portion 721 of the lower contact part 720 receives a rising force from a portion of the bundle of sheets, which has been pressed and raised by the lower teeth 62, that is, from the peripheral portion of a pushed portion of the bundle of sheets, thereby retreating far away from the bundle of sheets (downward in the pressing direction).

After the binding operation with respect to the bundle of sheets is completed as described above, when the cam 54 further rotates, a contact position between the cam 54 and the extruding link 60 changes, so that the extruding link 60 starts to shift from the extended state to the compressed state. Then, the upper teeth 61 and the lower teeth 62 are released from the pressed state thereof, and return to the state illustrated in FIG. 12C. Thereafter, when the cam 54 continues to rotate, the upper arm 51 and the lower arm 52 move to the downstream side in the entry and exit direction to reach the state illustrated in FIG. 12B, so that the opening between the upper arm 51 and the lower arm 52 widens. At this time, when the upper teeth 61 and the lower teeth 62 perform an operation of retreating to the downstream side in the entry and exit direction, in the process in which the upper teeth 61 and the upper teeth cleaning part 810 come into contact with each other and the upper teeth cleaning part 810 further slides relative to the upper teeth 61 from the downstream side to the upstream side in the entry and exit direction, the tip end 811 of the upper teeth cleaning part 810 comes into contact with the upper teeth 61 to bend, thereby cleaning the upper teeth 61. Likewise, in the process in which the lower teeth 62 and the lower teeth cleaning part 820 come into contact with each other and the lower teeth cleaning part 820 slides relative to the lower teeth 62 from the downstream side to the upstream side in the entry and exit direction, the tip end 821 of the lower teeth cleaning part 820 comes into contact with the lower teeth 62 to bend, thereby cleaning the lower teeth 62. Thereafter, the upper arm 51 and the lower arm 52 move to the downstream side in the entry and exit direction, return to the initial state illustrated in FIG. 12A, and stand by until a next binding operation starts.

As described above, in the present exemplary embodiment, in order to push the bundle of sheets when binding the bundle of sheets, the upper contact part 710, which is connected so as to be movable in conjunction with the movement of the upper arm 51 having the upper teeth 61, is provided, and the lower contact part 720, which is connected so as to be movable in conjunction with the movement of the lower arm 52 having the lower teeth 62, is provided, so that the bundle of sheets is pushed by the upper contact part 710 and the lower contact part 720. Then, at this time, the upper contact part 710 and the lower contact part 720 rotate about a certain rotation center, so as to simplify a pushing mechanism. In addition, at this time, the fulcrums of the upper contact part 710 and the lower contact part 720, which rotate, are set to different positions, which are sufficiently far from a pushing position of the upper contact part 710 and the lower contact part 720. This makes it possible for the flat surface of the end portion 711 of the upper contact part 710 and the flat surface of the end portion 721 of the lower contact part 720 to shift from the initial state to the pushing state while remaining in a state closer to a parallel state, thereby satisfactorily pushing the bundle of sheets in the vertical direction.

In addition, in the present exemplary embodiment, the upper teeth cleaning part 810 is provided on the upper contact part 710, which is slidably connected to the upper arm 51, and the lower teeth cleaning part 820 is provided on the lower contact part 720, which is slidably connected to the lower arm 52. When the upper teeth 61 and the lower teeth 62 provided on the upper arm 51 and the lower arm 52 move along a predetermined binding path (when the opening of the upper arm 51 and the lower arm 52 is closed and when the opening widens), the upper teeth cleaning part 810 provided on the upper contact part 710 comes into contact with the upper teeth 61 provided on the upper arm 51 and slides relative thereto, and the lower teeth cleaning part 820 provided on the lower contact part 720 comes into contact with the lower teeth 62 provided on the lower arm 52 and slides relative thereto. The upper teeth cleaning part 810 and the upper teeth 61 slide relative to each other and the lower teeth cleaning part 820 and the lower teeth 62 slide relative to each other, whereby the upper teeth cleaning part 810 and lower teeth cleaning part 820 clean the upper teeth 61 and the lower teeth 62 before performing a binding operation and after performing a binding operation. Thereby, it is possible to effectively remove paper dust adhering to the upper teeth 61 and the lower teeth 62.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding apparatus comprising:

a set of pressing parts configured to press and bind a bundle of recording materials from one side and a remaining side in a thickness direction; and a cleaning part configured to slide relative to the pressing part and clean at least one pressing part among the set of pressing parts when the pressing part moves along a predetermined binding path.

2. The binding apparatus according to claim 1, wherein the movement of the pressing part along the binding path has a component of a pressing direction movement in a direction where the bundle of recording materials is pressed and a component of an entry and exit direction movement in a direction where the recording material or the bundle of recording materials enters and exits with respect to a pressing region in which the bundle of recording materials is pressed, and in the sliding, the component of the entry and exit direction movement of the pressing part is greater than the component of the pressing direction movement.

3. The binding apparatus according to claim 1, further comprising a mounting member on which the cleaning part is provided, wherein the mounting member serves as a sheet pushing member that pushes the bundle of recording materials before the bundle of recording materials is pressed by the pressing parts.

4. The binding apparatus according to claim 1, wherein each pressing part has a tooth form for binding the bundle of recording materials, and the tooth form of the pressing part has teeth extending in parallel with an entry and exit direction where the recording material or the bundle of recording materials enters and exits.

5. The binding apparatus according to claim 1, wherein each pressing part has a tooth form for binding the bundle of recording materials, and the cleaning part is formed so as to engage with the tooth form according to a shape of teeth of the tooth form.

6. The binding apparatus according to claim 1, further comprising:

a case configured to support the set of pressing parts; a moving mechanism movably mounted to the case by meas of a moving mounting part; and a connecting mechanism movably mounted to the case by means of a connecting mounting part at a position different from that of the moving mounting part.

7. A binding apparatus comprising:

a set of pressing parts configured to be movable from a retreat position to a binding position and to press and bind a bundle of recording materials at the binding position; and a cleaning part provided to clean at least one pressing part among the set of pressing parts and configured to move, together with the pressing part, toward the binding position as the pressing part moves toward the binding position and to move, together with the pressing part, toward the retreat position as the pressing part moves toward the retreat position.

8. The binding apparatus according to claim 7, wherein the cleaning part is movably mounted to the pressing part by means of a mounting mechanism, and moves together with the pressing part as the pressing part moves.

9. The binding apparatus according to claim 8, wherein the cleaning part cleans the pressing part by sliding in conjunction with the movement of the pressing part, to which the cleaning part is mounted by means of the mounting mechanism.

10. An image processing apparatus comprising:

a transport unit configured to transport a recording material on which an image is formed;

an accommodating unit configured to accommodate therein a bundle of recording materials transported by the transport unit; and a binding apparatus configured to bind the bundle of recording materials accommodated in the accommodating unit, wherein the binding apparatus includes the binding apparatus according to claim 1.

* * * * *